US008021285B2

(12) United States Patent
Kushnir

(10) Patent No.: US 8,021,285 B2
(45) Date of Patent: Sep. 20, 2011

(54) ENDLESS CORD EXERCISE MACHINE WITH ROTARY VISCOUS DAMPERS

(76) Inventor: Eugene Kushnir, Pacifica, CA (US)

( * ) Notice: Subject to any disclaimer, the term of this patent is extended or adjusted under 35 U.S.C. 154(b) by 337 days.

(21) Appl. No.: 11/946,209

(22) Filed: Nov. 28, 2007

(65) Prior Publication Data

US 2009/0137370 A1 May 28, 2009

(51) Int. Cl.
*A63B 21/018* (2006.01)
*A63B 7/04* (2006.01)
*A63B 22/02* (2006.01)

(52) U.S. Cl. ..... 482/120; 482/37; 482/54

(58) Field of Classification Search ..... 482/37, 482/93, 96, 114, 120, 54; 182/42
See application file for complete search history.

(56) References Cited

U.S. PATENT DOCUMENTS 3,782,718 A * 1/1974 Saylor ..... 482/37
5,076,574 A * 12/1991 Johnson, Jr. ..... 482/37
5,318,491 A * 6/1994 Houston ..... 482/54
5,380,258 A * 1/1995 Hawley, Jr. ..... 482/37
5,492,515 A * 2/1996 Charnitski ..... 482/51
5,496,234 A * 3/1996 Sussich ..... 482/37
6,123,649 A * 9/2000 Lee et al. ..... 482/54
6,261,208 B1 * 7/2001 Carson, Jr. ..... 482/37
6,837,830 B2 * 1/2005 Eldridge ..... 482/54
7,018,323 B1 * 3/2006 Reynolds et al. ..... 482/37
7,066,865 B2 * 6/2006 Radow ..... 482/4
7,086,991 B2 * 8/2006 Williams et al. ..... 482/37
7,303,506 B1 * 12/2007 Reynolds et al. ..... 482/37
7,387,593 B2 * 6/2008 Ryan et al. ..... 482/37
7,524,272 B2 * 4/2009 Bruck et al. ..... 482/127
2005/0124471 A1 * 6/2005 Wilkinson ..... 482/121

* cited by examiner

*Primary Examiner* — Allana Lewin
(74) *Attorney, Agent, or Firm* — David E. Newhouse, Esq.

(57) ABSTRACT

An endless cord exercise machine in which a user applies a continuous pulling motion to a cord that is attached to a resistance mechanism is disclosed. The machine may be arranged to simulate the acts of rope climbing or of scaling a wall with the assistance of a rope, or may be arranged to provide other types of upper and lower body muscle development. The resistance mechanism is ideally comprised of a plurality of rotary viscous dampers of differing viscosities housed in a rotating drum. A spring-loaded adjustment key mechanism extending through the hub of the drum and dampers allows the user to selectively engage any combination of dampers to provide exercise resistance.

11 Claims, 20 Drawing Sheets

10

10

10

28
22
20
48
50
24
36
42
32
39
28
27
26

50

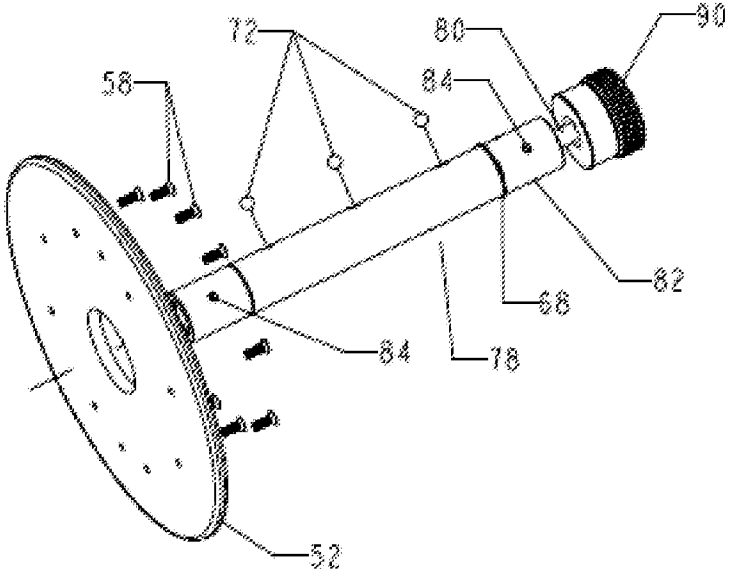
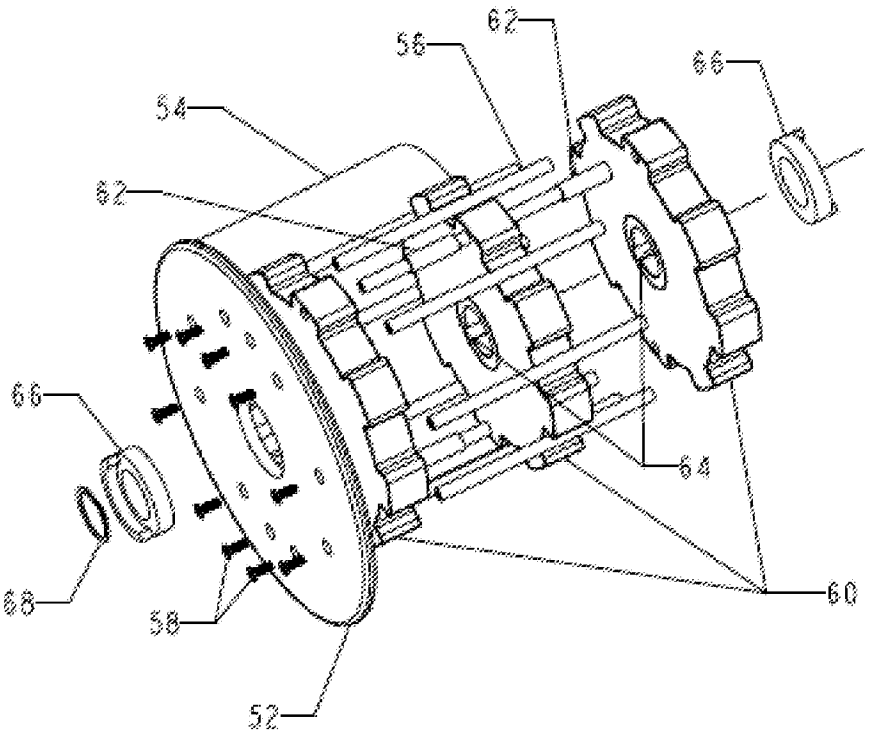
Fig. 5B 50

10

ENDLESS CORD EXERCISE MACHINE WITH ROTARY VISCOUS DAMPERS

BACKGROUND OF THE INVENTION

1. Field of the Invention

The present invention relates to exercise equipment, and in particular to exercise equipment that allows the user to gain both muscle development and cardiovascular benefit by simulating the actions of wall scaling and rope climbing and providing other continuous motion resistance exercises through use of a looped—hence endless—cord.

2. Description of the Prior Art

The desire to improve physical fitness remains a widespread goal in contemporary society, and individuals are constantly seeking new means to build strength and cardiovascular endurance. Exercise machines often attempt to provide a simulated version of popular outdoor exercises such as treadmills for walking and running, stationary bicycles for bicycling, skiing machines for cross country skiing. Alternately, some exercise machines have taken ordinary body motions not traditionally considered exercise activities (stair climbing machines, for example) and transformed them into popular exercise routines. More recently, exercise machines have been created to simulate popular outdoor exercise activities (rock climbing), or have brought renewed interest to sports that had declined in popularity (rope climbing). The exercise machines do not provide users with the same experience as the outdoor exercises, but generally make those exercises more convenient and accessible in that the machines do not require large spaces, do not depend on the weather, and can be availed by users of widely varying abilities.

The present invention is for an endless cord exercise machine that provides the user with a variety of ways to build strength and cardiovascular endurance through the act of pulling on the cord. In one of its preferred embodiments the user performs an act that simulates scaling a wall with the assistance of a rope, such as is part of military training. Although there are exercise machines that simulate rope climbing (see below), vertical stair and ladder climbing (for example, U.S. Pat. No. 4,822,029, U.S. Pat. No. 5,145,475, U.S. Pat. No. 5,328,422), mountainous hiking (U.S. Pat. No. 6,095,952, U.S. Pat. No. 6,761,667), and rock wall climbing (U.S. Pat. No. 5,125,877, U.S. Pat. No. 6,860,836, U.S. Pat. No. 5,919,117) there is not an exercise machine to simulate wall scaling with the assistance of a rope. For example, the present machine allows a user to walk up an inclined plane with the user's body oriented substantially parallel to the ground. In other embodiments the machine simulates the act of rope climbing.

Rope climbing, or the act of pulling one's body up a rope, provides excellent muscle strength development of the forearm, biceps, triceps, as well as pulling and grip strength. However, as a regular exercise method, traditional rope climbing has a number of limitations for both novice and advanced athletes. The rope must be suspended above the user, and the height of the climb is limited by the height at which the rope is fixed, meaning it can only be attempted in environments with unusually high ceilings or a very tall support structure. For the beginner, traditional rope climbing requires that individuals already have sufficient strength to support their own body weight. Advanced climbers have few options to increase the resistance provided by their own body weight. The height of the rope exposes the users to the dangers of falls, or serious rope burns from a too-rapid descent. The same disadvantages apply to wall scaling with the assistance of a rope in the real world, which requires a tall wall with a rope attached to the top.

Although there are no other exercise machines that simulate the act of wall scaling with the assistance of a rope, there are a number of other machines that simulate rope climbing or mimic the health benefits of rope climbing, and they overcome some of the disadvantages of climbing a hanging rope. These machines provide an endlessly high rope for the user to climb, limited only by the user's ability and stamina, rather than by the physical constraints of ceiling height or rope length. As compared to other upper body exercise machines, the benefit of continuous cord machines is that they only offer resistance according to the user's pull. Thus continuous cord exercise machines eliminate the problem of lifting more weight than the user is able to safely return to its resting position, an issue that often results in muscle strains and injuries. The machines also eliminate any possibility of dropped weights, which can also lead to injury. As these machines have been refined, they have become popular equipment in many gyms.

However, the existing rope climbing or endless rope exercise machines also suffer from a number of drawbacks that the present invention overcomes. These include size and complexity of the machine, flexibility of the mechanism and equipment configuration, ease and cost of manufacture, and robustness and serviceability of the equipment. In a machine of this sort, there is a need to keep the rope in the proper track, and most machines do this by stretching the rope between two or more pulleys or wheels. The extra wheels can get in the way of the user (U.S. Pat. No. 5,496,234, U.S. Pat. No. 3,599,974), or require a large amount of space to operate the machine (U.S. Pat. No. 5,060,938, U.S. Pat. No. 5,076,574). Resistance is most often applied by friction from a pad or belt (U.S. Pat. No. 5,496,234, U.S. Pat. No. 3,599,974, U.S. Pat. No. 641,519), which is simple but does not provide a smooth or natural resistance. More complex resistance means include hydraulics (U.S. Pat. No. 7,018,323), hanging counterweights (U.S. Pat. No. 7,086,991), a motor (U.S. Pat. No. 5,484,360), or a combination of elements (U.S. Pat. No. 5,060,938).

The drawbacks of these more sophisticated machines are that they take up more space, are expensive to manufacture, have more parts to maintain and service, and are therefore less reliable, more complicated to use, and less suited for the tight spaces in today's gyms or for home use. As will become clear from the subsequent description, the present invention overcomes these disadvantages in the form of a machine that is small, simple, and elegant in design, inexpensive to manufacture, maintain, and use, and provides the muscular benefits of rope climbing.

The present invention uses rotary viscous dampers for resistance. Rotary viscous dampers are an ideal source of resistance in an exercise machine, because resistance is variable depending on speed. Thus, the faster the user rotates the resistance mechanism, the harder the resistance is applied. Although previous exercise equipment inventions (U.S. Pat. No. 5,190,511, U.S. Pat. No. 5,749,807, U.S. Pat. No. 5,816,372) have made use of single rotary dampers for resistance, none have combined multiple dampers of differing viscosities to achieve a variety of resistance levels. This resistance mechanism using multiple rotary dampers is flexible, robust, and will not wear out. In addition, the resistance mechanism of the invention could be used for other exercise machine applications, or in situations where adjustable resistance is required. Rotary dampers are used widely in aerospace for aircraft flight controls and satellite solar panels, as well as in industrial application to control heavy doors and lifts. For example, the damper mechanism of this invention could be used to control a lift that bears varying weights.

The use of multiple rotary viscous dampers for resistance requires a unique mechanism to provide adjustment means. The invention uses a spring loaded key mechanism to select the desired resistance level. The key allows the user to engage varying combinations of the multiple dampers by simply pushing the selector mechanism handle against the spring and rotating it to one of the fixed positions. Although the key assembly is loaded with a large spring, the mechanism includes multiple floating keys, each loaded with its own smaller spring, making the assembly simpler to manufacturer, easier for the user to engage, and more effective and robust in function.

The preferred embodiment of the invention that acts as a wall-scaling simulator machine uses an inclined movable belt mechanism such as a treadmill, as well as a looped cord, both of which are linked to the resistance mechanism. Inclined treadmills are disclosed in the prior art, including many in which the slope adjusts during the workout (U.S. Pat. No. 6,945,914, U.S. Pat. No. 6,945,912). Combining the inclined movable belt mechanism with a looped rope for pulling allows the belt mechanism to be much more steeply inclined—as much as ninety degrees—to simulate the act of scaling a wall with the assistance of a rope. This combination of a rope-pulling machine and inclined movable belt that allows a steep or vertical ascent or descent on the belt while the user's body is substantially horizontal with the ground, is unique in the art. It provides an endless wall for the user to scale, it's height limited only by the user's ability.

BRIEF SUMMARY OF THE INVENTION

The present invention is a unique type of endless cord exercise machine that overcomes the above-described deficiencies in the art in a design that is both simple and elegant. In one preferred embodiment the invention acts as both a wall-scaling simulator exercise machine and a rope-climbing simulator exercise machine. A horizontal frame rests on the floor and supports a vertical frame that extends upward to a height above that of an average human. A movable belt assembly such as a treadmill extends upward from the floor along the vertical frame, and is attached to the frame. At the top of the movable belt assembly and on the other side of the vertical frame is mounted a resistance mechanism, comprising a drum assembly containing rotary viscous damp ers. A drive belt connects the movable belt to the drum by means of gears mounted to an upper movable belt roller and to the drum assembly.

A cord is formed into a single continuous loop and then wrapped several times tightly around the drum to exert a chokehold on the drum. The outer surface of the drum is covered with a rubberized or pliable material so that the cord grasps the drum tightly. The remaining looped portion of the cord is threaded upward over a set of pulleys that are attached to the top of the vertical frame. The remaining portion of the cord hangs down freely from the drum at a length so that the user can easily and firmly grasp it. Cylindrical bearings mounted to a fork that holds the drum onto the frame of the exercise machine facilitate the smooth movement of the cord as it comes off of, and is taken up by, the drum, and prevents the cord from tangling against itself.

Inside the drum are a series of rotary viscous dampers, each with a different viscosity and hence a different resistance rating. A spring-loaded adjustment mechanism acting as a key passes through the hub of the drum and center axis of the rotary viscous dampers, allowing the user to engage any combination of the rotary viscous dampers to achieve a desired level of resistance on the drum. Using multiple rotary dampers of differing viscosities together creates a variable resistance mechanism at a fraction of the cost of adjustable resistance rotary viscous dampers currently on the market. When the user pushes the adjustment key mechanism in against its spring, it is able to rotate freely. Individual setting points are located evenly around the circumference of the key mechanism. Each setting engages a different combination of dampers by forcing bearings housed inside the key to either engage with or not engage with the dampers. Releasing the adjustment mechanism locks it into place. The adjustment mechanism of this invention could be used in any application where multiple resistance mechanisms are used to achieve adjustable rotary resistance.

To operate the machine the user first selects a resistance level as described above, and then pulls on the cord, causing the cord to grasp the drum tightly and begin to rotate against its resistance. Using the rope as leverage, the user can then swing the user's legs up onto the movable belt. The user's legs will thus be roughly parallel to the ground. As the user pulls on the rope and walks up the movable belt, the resistance mechanism is rotated. As cord comes off the drum on one side, it is taken up by drum on the other side. The resistance mechanism is bidirectional, enabling the user to simulate the act of scaling the wall, or the act of descending the wall. The rope and the movable belt move in sync with one another.

In another embodiment of the invention, there is a bench in place of the movable belt assembly, and the machine acts as a rope-climbing simulator or simply a cord-pulling exercise machine. In various other embodiments of the invention, the drum can be positioned so that the user is below it and pulling down on the cord, mimicking the action of climbing a rope. Alternately, the drum can be positioned so that the user is pulling the cord in a direction parallel to the ground, or at an angle up from the ground, to work a variety of upper body muscles. In one embodiment of the invention the user is seated on a sliding seat, and can also gain exercise benefit for lower body muscles.

It is an object of this invention to provide an endless cord exercise machine that is simple to use, yet allows the user to perform a wide variety of exercises.

It is another object of this invention to provide a wall-scaling simulator exercise machine that combines an inclined movable belt assembly with an overhead cord that are both attached to a resistance mechanism.

It is another object of this invention to provide a resistance mechanism for exercise equipment or other applications that is adjustable, provides a smooth continuous resistance, is variable depending on the speed of rotation caused by the user, and will not wear out.

It is another object of this invention to provide an endless cord exercise machine that is compact and lightweight enough for home use or for use in small gym spaces, yet is robust enough for regular use with very little maintenance.

It is another object of this invention to provide an endless cord exercise machine that can be produced inexpensively.

It is another object of this invention to provide an endless cord exercise machine with very few moving parts in order to minimize the cost of manufacture, and reduce wear and tear on the machine, thereby lessening maintenance costs.

BRIEF DESCRIPTION OF THE DRAWINGS

FIG. 1B is a perspective view from the front of a preferred embodiment of the exercise machine with inclined movable belt assembly.

FIG. 5B is an alternate exploded perspective view of the drum assembly for alternate embodiments of the invention.

DETAILED DESCRIPTION OF THE INVENTION

Figure 1A:
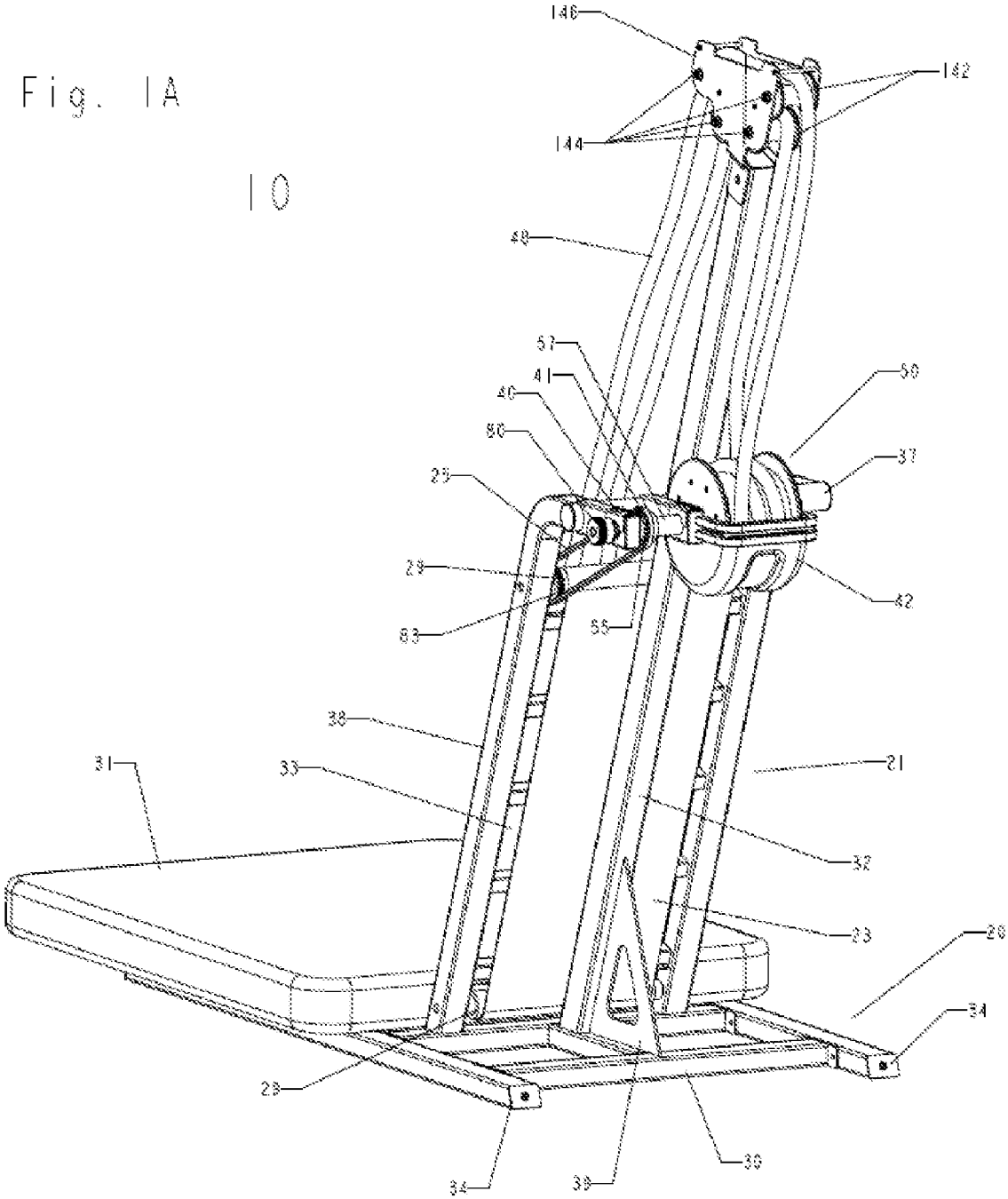
FIG. 1A is a perspective view from behind of a preferred embodiment of the exercise machine with inclined movable belt assembly.
Figure 18:
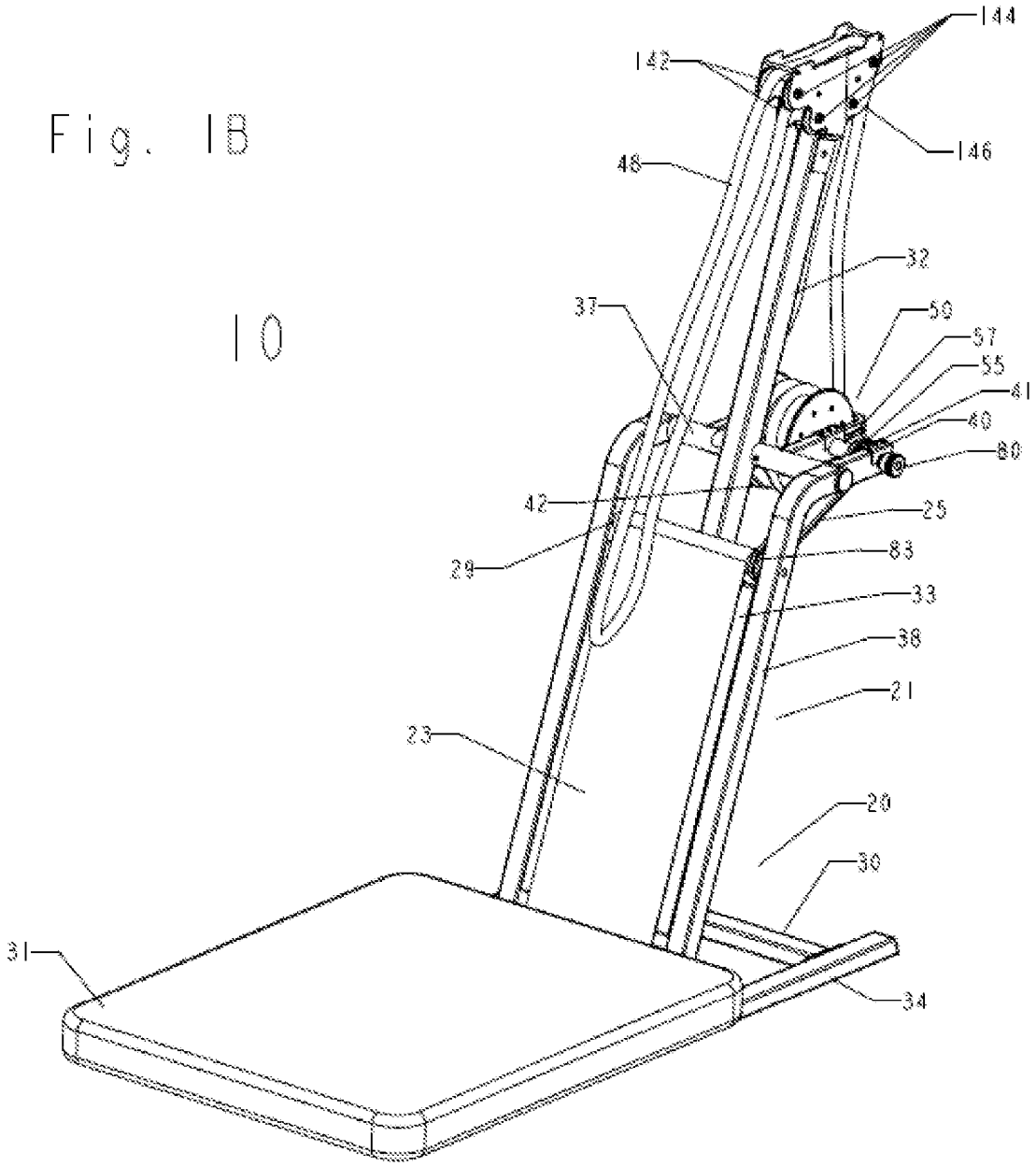

Referring now to FIGS. 1A and 1B, a preferred embodiment of the machine of this invention is an exercise machine 10 is shown. The machine is comprised of a steeply inclined movable belt assembly 21, a rotating drum assembly 50 that serves as a resistance mechanism, and a set of cord support pulleys 142 mounted to a frame 20. The machine allows a user to simulate the act of scaling a wall with the help of a rope as well as the act of rope climbing, and can also serve as a continuous motion cord pulling exercise machine. The exercise machine 10 has a support frame 20, which includes horizontal base members 30 and a vertical support member 32. In a preferred embodiment the horizontal base members 30 are arranged in an H-shape, to provide stability, but could be of any shape that provides sufficient stability to the frame as a whole. Attached perpendicularly to each end of the horizontal base members 30 are two horizontal support members 34 that further stabilize the frame. The vertical support member 32 is attached to the horizontal base member 30 at a point between the horizontal support members 34, and extends upward in a plane perpendicular to the plane created by the horizontal base member 30 and the horizontal support members 34. In this preferred embodiment, the vertical support member 32 extends upward at an angle of approximately 105 degrees to the horizontal base member 30. Four cord support pulleys 142 rotate freely on pulley axles 144, and are attached to the top of the vertical support member 32 by means of a pulley support member 146. A triangular-shaped frame stiffening gusset 39 is mounted at the joint between the horizontal frame member 30 and the vertical frame member 32 to provide additional support, since the joint they form bears much of the stress exerted by the user on the frame.

The vertical support member 32 supports an inclined movable belt assembly 21, on which the user walks, as well as a set of pulleys 142, through which is threaded a cord 48 that is attached to a resistance mechanism 50. In a preferred embodiment the resistance mechanism is a rotating drum assembly 50. The movable belt assembly 21 is mounted to a vertical movable belt support frame 38 that extends upward from the horizontal base member 30 along the vertical support member 32. The sides of the movable belt support frame 38 extend above the movable belt assembly 21, and then curve back towards the vertical support member 32, where they are attached to it by means of a horizontal drum support member 37 (more clearly visible in FIG. 1B). The right side of the movable belt support frame 38 extends past the vertical support member 32 to support the handle end of an adjustment key assembly 78 (described below). Extending out from the horizontal drum support member 37 is a fork member 40 that supports the rotating drum assembly 50.

The frame 20 may be made from any material strong enough to withstand the forces exerted by the user when exercising on the machine. Steel tubing is a preferred material because it is strong, relatively inexpensive, and easy to work with. Examples of other materials are alloys, composites, aluminum, carbon fiber, plastic or reinforced fiberglass. The individual support members 30, 32, 34, 36, 37, 38, 39, and 40 described above that comprise frame 20 may be attached by any means sufficient to establish a strong enough connection to withstand the forces exerted by the user on the exercise machine. These include one or a combination of methods such as welding, attaching with plates and screws or bolts, or fitting the pieces together with male and female joints as would be familiar to one skilled in the art. Welding the joints provides the strongest connection, however this requires the frame 20 to be transported in one piece.

The frame 20 described above is one of the preferred embodiments of the exercise machine, however many other frame constructions are possible, some of which will be described below as additional preferred embodiments. In addition, a version of the exercise machine can be made using only the fork member 40 as a frame. To use the machine, the fork member 40 must then be mounted to another structure, such as a wall, ceiling, doorframe, or other structure to provide support. The user may then pull on the cord 48 against the resistance provided by the rotating drum assembly 50 to achieve the desired physical exercise.

In a preferred embodiment the movable belt assembly 21 may be a common treadmill apparatus as is well known in the art of exercise equipment. The movable belt assembly 21 includes a movable belt 23 that is stretched between two belt rollers 29, the ends of which are attached to the movable belt support frame 38 so that they may rotate freely. When the belt rollers 29 turn, the movable belt 23 moves over a movable belt deck 33 (obscured in the drawing by the movable belt 23, but a standard component of any treadmill) that covers the area between the supports of the movable belt support frame 38 and provides support for the movable belt 23.

Figure 1C:
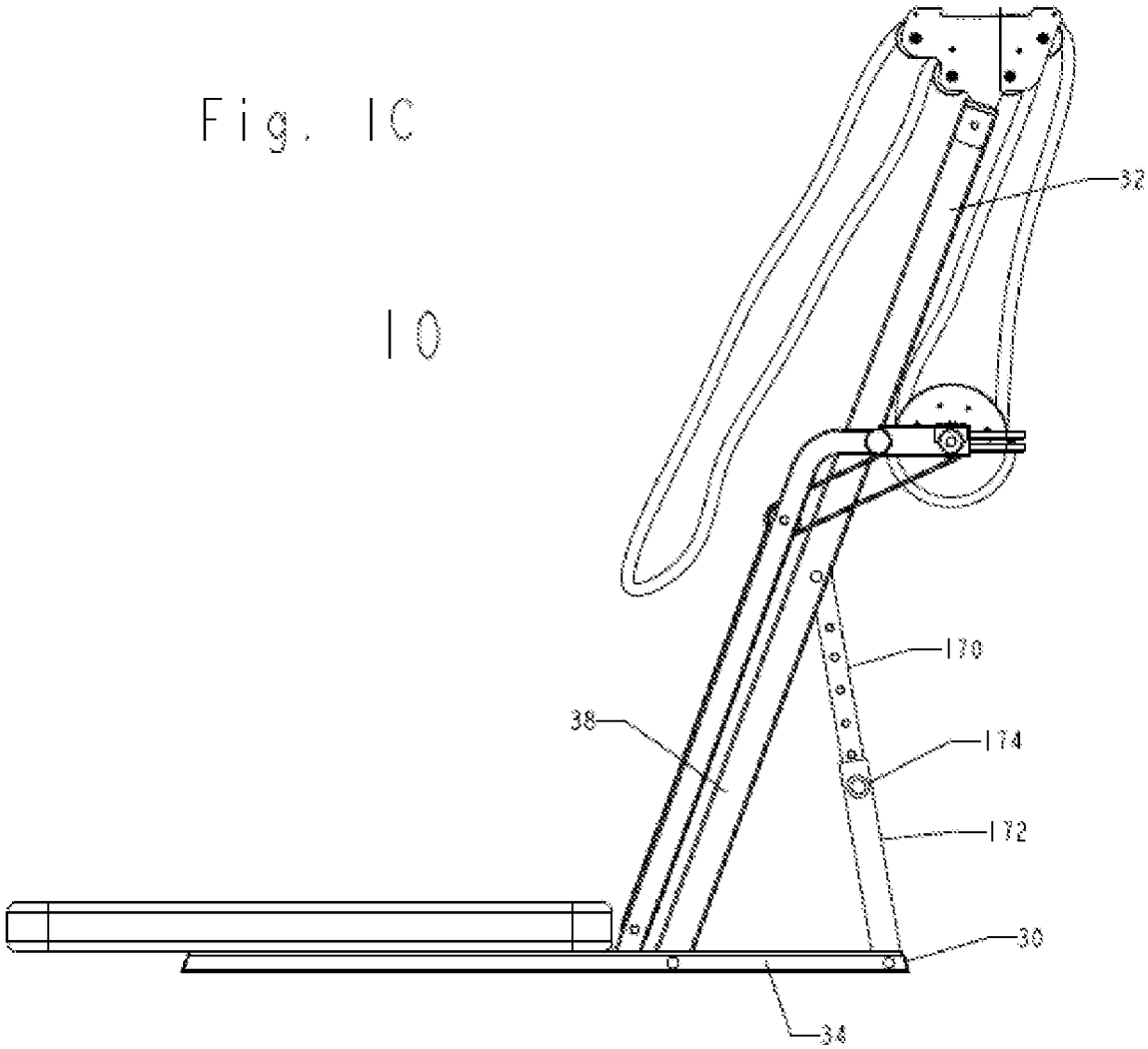
FIG. 1C is a side view of a preferred embodiment of the exercise machine, showing the ability to adjust the inclination of the movable belt assembly.

If it is possible to incline the movable belt 23 at any deemed desirable, by simply altering the slope of the vertical support member 32 and the other frame 20 elements that it supports. Alternately, the slope of the movable belt assembly 21 may be made adjustable, in which case the frame design must also be modified accordingly. FIG. 1C shows an adjustable version of the machine. The point at which the movable belt support frame 38 meets the horizontal base member 30 and the point at which the movable belt support frame 38 meets the vertical support member 32 are hinged. A female frame adjustment support member 172 is hinged to the center back edge of the horizontal base member 30, directly opposite the vertical support member 32. A male frame adjustment support member 170 that fits inside the female frame adjustment support member 172 is hinged to the vertical support member 32 at a point below the top edge of the movable belt support frame 38. The female frame adjustment support member 172 has a hole punched near the top, and the male frame adjustment support member 170 has a series of holes spaced along its length. A frame adjustment pin 174 that fits the holes of the male and female adjustment support members 172 and 174 is used to lock the male and female adjustment support members 172 and 174 together, thereby allowing the inclination of the movable belt support frame 38 and its attached assembly. Other possible modifications to achieve this result will be obvious to one skilled in the art of exercise equipment design.

Covering the horizontal support members 34 at the bottom of the movable belt assembly 21 is a safety mat 31, ideally comprised of high-density foam, rubber, or another cushioning material, to protect against accidental falls from the inclined movable belt 23. Optionally, a tread gear release switch (not shown) may be installed, allowing the user to disengage the movable belt 23, and use the machine as a cord-pulling exerciser only.

The rotating drum assembly 50 provides resistance for the exercise machine 10. A looped cord 48 is wrapped several times around the drum assembly 50. The cord 48 may be a braided rope, or a wire or chain covered in a rubberized material, or any other suitable material of sufficient strength and flexibility and with a thickness comfortable for a user to grasp. The two ends of the cord 48 must be joined together, forming a loop. The preferred embodiment uses a rope, joined together by inserting one end of the rope into the fibers of the other end, and weaving the exposed strands together, however any suitable means may be used. In a preferred embodiment, the cord 48 is looped tightly around the drum 54 (visible in FIGS. 4A-5B) of the rotating drum assembly 50 three times, causing the cord 48 to wrap tightly around the drum assembly 50 when pulled by a user. In order to ensure smooth movement of the cord 48, and to prevent the cord 48 from catching upon itself, three cord bearing components 44 (visible in FIG. 3C) are mounted to the horizontal drum support member 37. The cord bearing components 44 are comprised of spindles on which rotate cylindrical bearings. The spindles are mounted to the horizontal drum support member 37 and support the cylindrical bearings, which rotate freely as the cord 48 passes between them. The cord 48 is wrapped so that each of the three loops around the drum assembly 50 passes to the right of a cord bearing component 44. The cord 48 may be wrapped around the drum 54 fewer than three or more than three times. However, if the cord 48 is wrapped fewer than three times, it may not hold tightly enough to the drum 54. If it is wrapped more than three times, a larger drum 54 may be required and there is more of a chance that the cord 48 will catch upon itself. One cord bearing component 44 is required for each loop of the cord.

A drum cover 42, preferably made of plastic or other durable, lightweight material, encases the top half of the drum assembly 50. The drum cover 42 is primarily for aesthetic purposes, but in some circumstances can prevent the cord 48 from riding up on itself. While the preferred embodiment of the invention uses the rotating drum assembly 50 as the resistance mechanism, any resistance mechanism, manual or motorized may be used. For example, a simple drum with an adjustable disk brake, or an electric motor with sufficient torque may be used as the resistance mechanism.

Both ends of the looped cord 48 come off the drum assembly 50 and are looped over four free-spinning cord support pulleys 142, attached with pulley axles 144 to a pulley support member 146 mounted at the top of the vertical support member 32. The strand of cord 48 coming off the back of the drum assembly 50 loops upward over the top two cord support pulleys 142, while the strand of cord 48 coming off the front of the drum extends in between the bottom two cord support pulleys 142 and the top two cord support pulleys 142. The looped end of cord 48 then hangs down from the cord support pulleys 142 to a point below the top of the movable belt assembly 21.

A drum gear 55 that is part of a drum gear connector assembly 57 (visible in greater detail in FIG. 4B) is fixed to the rotating drum assembly 50. A belt roller gear 83 is attached to the upper movable belt roller 29. A drive belt 25 links the two gears 55 and 83, transmitting power between the resistance mechanism 50 and the movable belt 23. Together the drum gear connector assembly 57, the belt roller gear 83 and the drive belt 25 comprise a transmission mechanism 41. The gears 55 and 83 and drive belt 25 may be of any type sufficient to bear the force exerted on the resistance mechanism 50. For example, bicycle chain ring gears and a bicycle chain may be used. When the cord 48 is pulled, it causes the rotating drum assembly 50 along with the drum gear connector assembly 57 to rotate, which in turn causes the belt roller gear 83, belt roller 29 and movable belt 23 to rotate. In the preferred embodiment, all of these parts can rotate in both directions. An adjustable transmission system (not shown) may be used to allow the resistance mechanism 50 and the movable belt 23 to rotate at differing rates. For example, instead of one drum gear 55, there could be a plurality of drum gears that are close together, and adjusted by means of a derailleur assembly and shift lever, as in the front derailleur of a bicycle.

Referring now to FIGS. 4A, 4B, 4C, and 4D the drum assembly 50 comprises two circular end plates 52 mounted on either end of a drum 54. The drum 54 is made from a rigid substance, but coated on the outside with a polyurethane or other rubber-like substance that provides a surface that will grip the cord 48 when it is wound around the surface of the drum 54. The end plates 52, which preferably are constructed of stainless steel, are held on either end of the drum 50 by a series of connector pipes or rods 56, spaced evenly around the inside circumference of the drum 50 and connected with fasteners 58 (one for each end of each pipe) that extend through holes in the end plates 52, through holes in the plate of the drum gear connector assembly 57, and into the pipes 56. The preferred embodiment of the invention uses threaded metal connector pipes with corresponding machine screws as fasteners, but any fastening mechanism that securely holds the drum together could work. The drum gear connector assembly 57 comprises a shaft with connected plate and the drum gear 55. The shaft of the drum gear connector assembly 57 extends out of the drum 54 through the drum end plate 52, with the plate portion of the drum gear connector assembly 57 remaining inside the drum 54. The drum gear 55 is positioned on the shaft of the drum gear connector assembly 57 outside of the drum 54. An adjustment key assembly 78 that includes an adjustment key shaft 82 extends through the center axis of the drum assembly 50. Teflon drum bushings 66 fit onto the adjustment key shaft, and into the center hole of the end plates 52 and are held in place by drum bushing snap rings 68 that fit into grooves on the adjustment key shaft 82. The drum bushing 66 prevents lateral motion between the drum assembly 50 and fork member 40, and also bears some of the non-rotating force exerted on the drum assembly 50 as the user rotates it.

Three rotary viscous dampers 60 are arranged serially along a single center axis, and housed inside the drum 54. They provide the resistance for the exercise machine. The rotary viscous dampers 60 will ideally be of the types that rotate in both directions, such as the Enidine VSG available from Enidine, Inc. located in Orchard Park, N.Y. 14127. The inside circumferential profile of the drum 54 ideally matches the outer circumferential profile of the rotary viscous dampers 60 and the connector pipes 56, in order to hold the dampers and pipes firmly in place. Two of the connector pipes 56 actually pass through holes in the rotary viscous dampers 60 located near their outer edges, as well as through damper spacers 62 that keep the dampers evenly spaced within the drum 54, further binding the rotating portion of the damper with the drum 54. Each damper has a damper engagement notch 64 in its center hole that allows it to be engaged by key bearings 72 in an adjustment assembly 78 (discussed below). On many dampers, the engagement notches 64 are plastic and rectangular. Therefore metal inserts with convex hemisperhical surfaces (not shown) optionally may be added to the damper engagement notches 64 to achieve a better fit between the key bearings 72 and the damper engagement notches 64.

Ideally each damper 60 will be rated at a different viscosity so that the dampers can be engaged in varying combinations to provide different levels of resistance. For example, an ideal embodiment of the invention will employ a first damper with a rating of 100,000 centistokes (cSt., the standard measure for kinematic viscosity), a second damper with a rating of 300,000 cSt., and a third damper with a rating of 600,000 cSt. This will allow for eight different resistance settings: 1) engaging none of dampers will add no viscous resistance to the rotation of the drum assembly on its own; 2) engaging the first damper alone will provide 100,000 cSt. of viscosity; 3) engaging the second damper alone will provide 300,000 cSt. of viscosity; 4) engaging the first and second dampers together will provide 400,000 cSt. of viscosity; 5) engaging the third damper alone will provide 600,000 cSt. of viscosity; 6) engaging the first and third dampers together will provide 700,000 cSt. of viscosity; 7) engaging the second and third dampers together will provide 900,000 cSt. of viscosity; and 8) engaging all three dampers together will provide 1,000,000 cSt. of viscosity. The actual resistance rating of each damper could be varied to provide a different set of eight resistance levels. Although any number of dampers may be used to achieve a variety of resistance levels, three rotary viscous dampers is an ideal number because using two dampers will allow only for four different resistance levels, and using more than three dampers would require a larger drum, and offer more resistance levels than is practically necessary.

The benefits of using multiple rotary viscous dampers in combination to achieve multiple resistance levels are considerable. Although adjustable resistance rotary viscous dampers are available for sale from various manufacturers, they are very expensive at the viscosities required by the exercise machine—as much as ten times the cost of purchasing multiple dampers to achieve a similar level of adjustability. Thus, arranging multiple rotary viscous dampers serially along a center axis to create a rotating drum assembly with variable resistance offers a considerable innovation in the ability to manufacture high quality exercise equipment at a lower cost. The rotating drum assembly 50 of this invention could be used with other exercise machines as well, such as an exercise bicycle or weight machines. Rotary dampers are also used widely in aerospace for aircraft flight controls and satellite solar panels, as well as in industrial applications to control heavy doors and lifts. For example, the damper mechanism of this invention could be used to help control the movement of a lift that bears varying weights.

In a preferred embodiment of the invention, the adjustment mechanism is an adjustment key assembly 78, comprised of an adjustment key mechanism 80 housed in an adjustment key shaft 82, and sprung by a shaft spring 92. The adjustment key assembly 78 extends through the hole in the center of the drum assembly 50, passing through the end plates 52, the drum gear connector assembly 57, the drum bushing 66, and the center axis of the rotary viscous dampers 60. The adjustment key shaft 82 is connected with fork pins 84 to the fork member 40 as well as to the extending portion of the movable belt support frame 38.

Figure 4A:
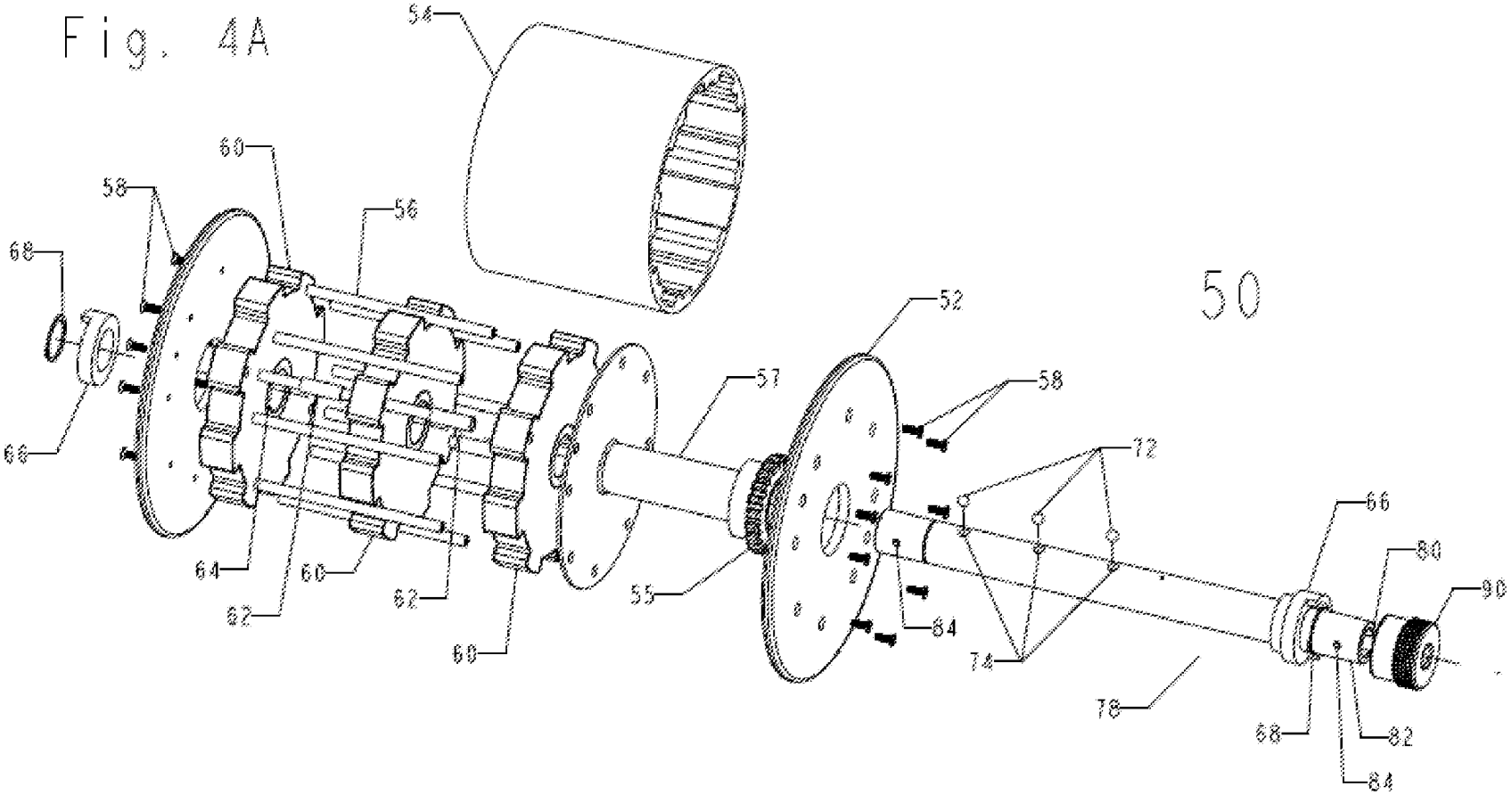
FIG. 4A is an exploded perspective view of the drum assembly for the wall-scaling simulator machine.
Figure 4B:
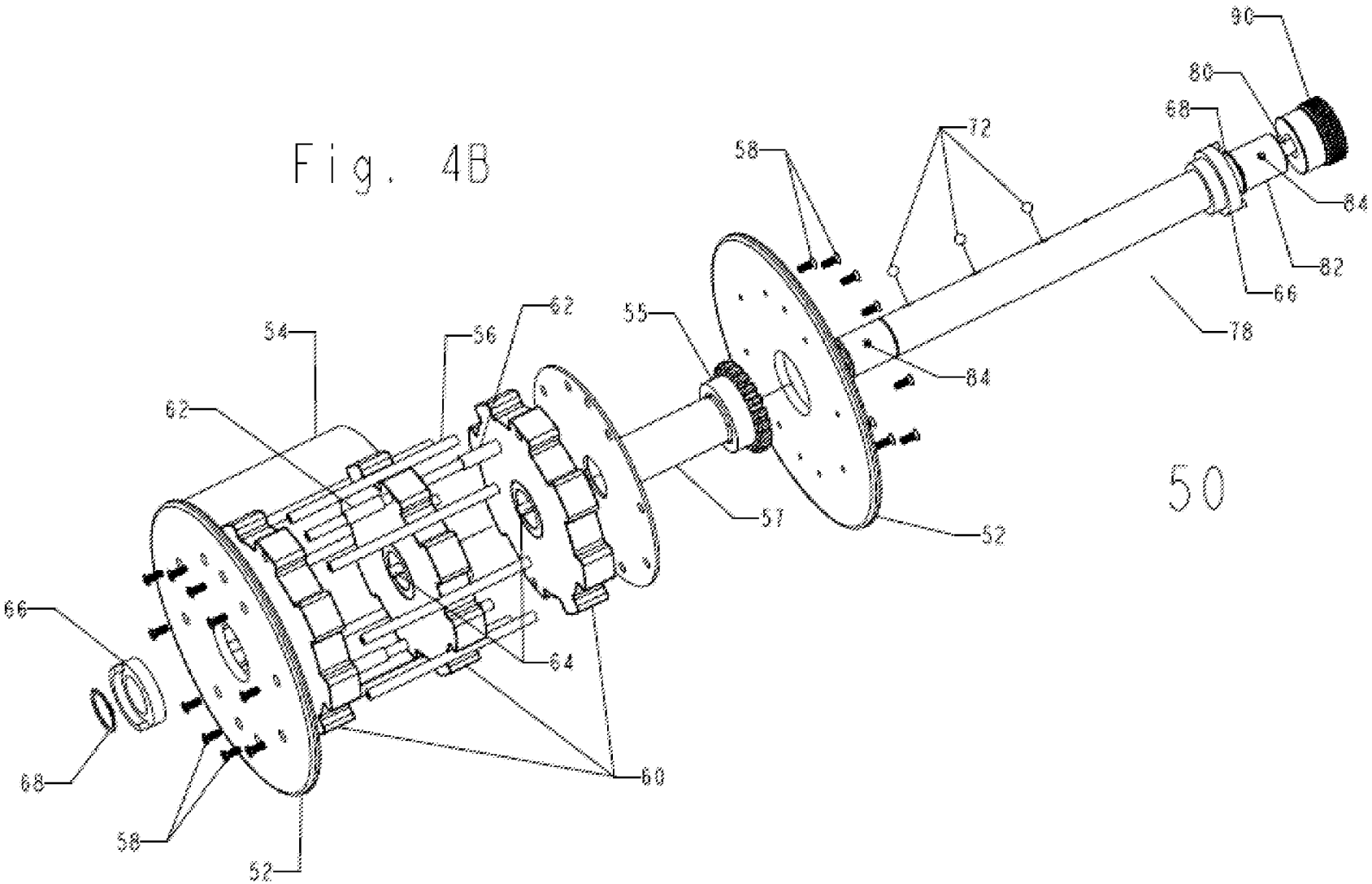
FIG. 4B is an alternate exploded perspective view of the drum assembly for the wall-scaling simulator machine.
Figure 4C:
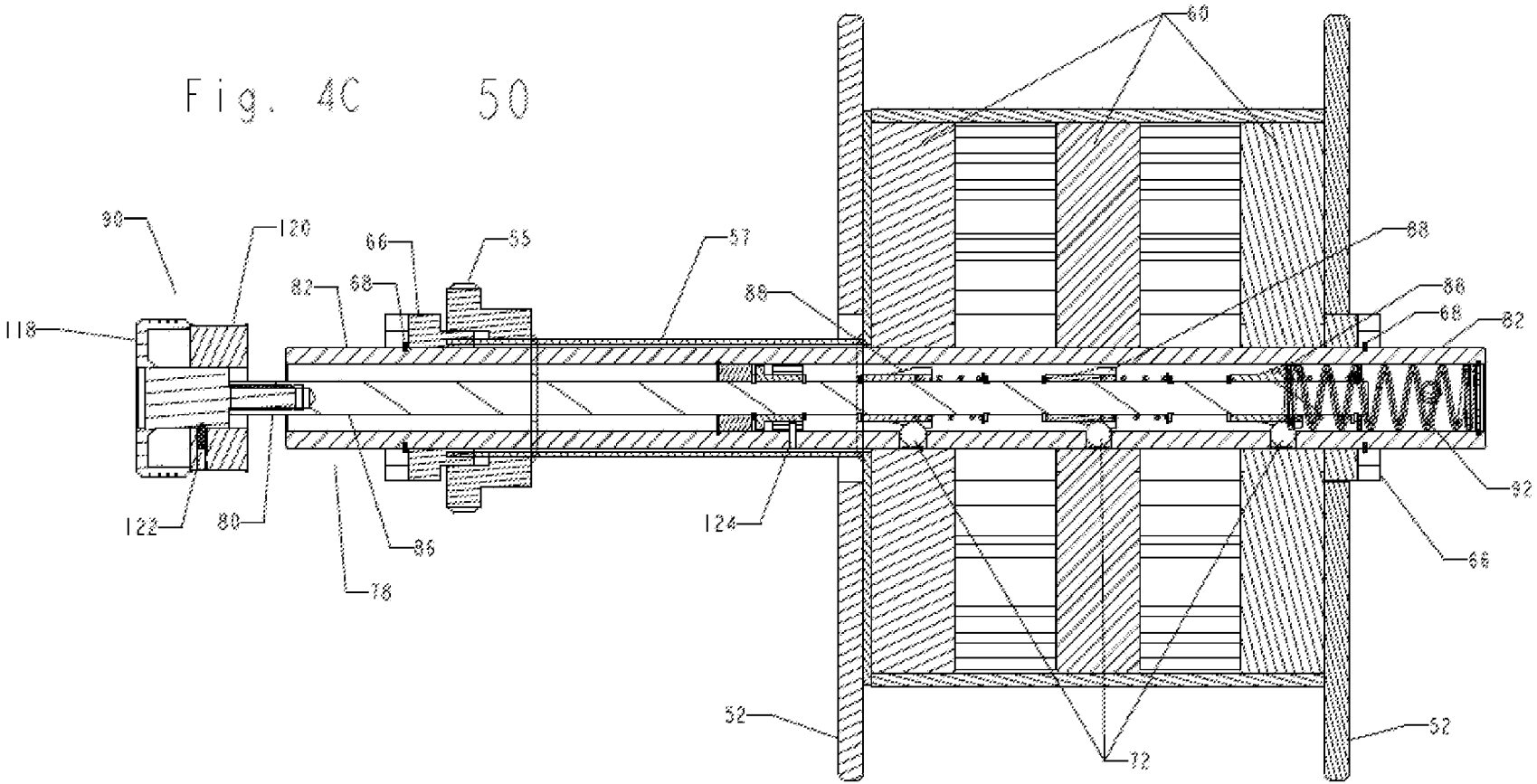
FIG. 4C is a cross section of the rotating drum assembly for the wall-scaling simulator machine.
Figure 4D:
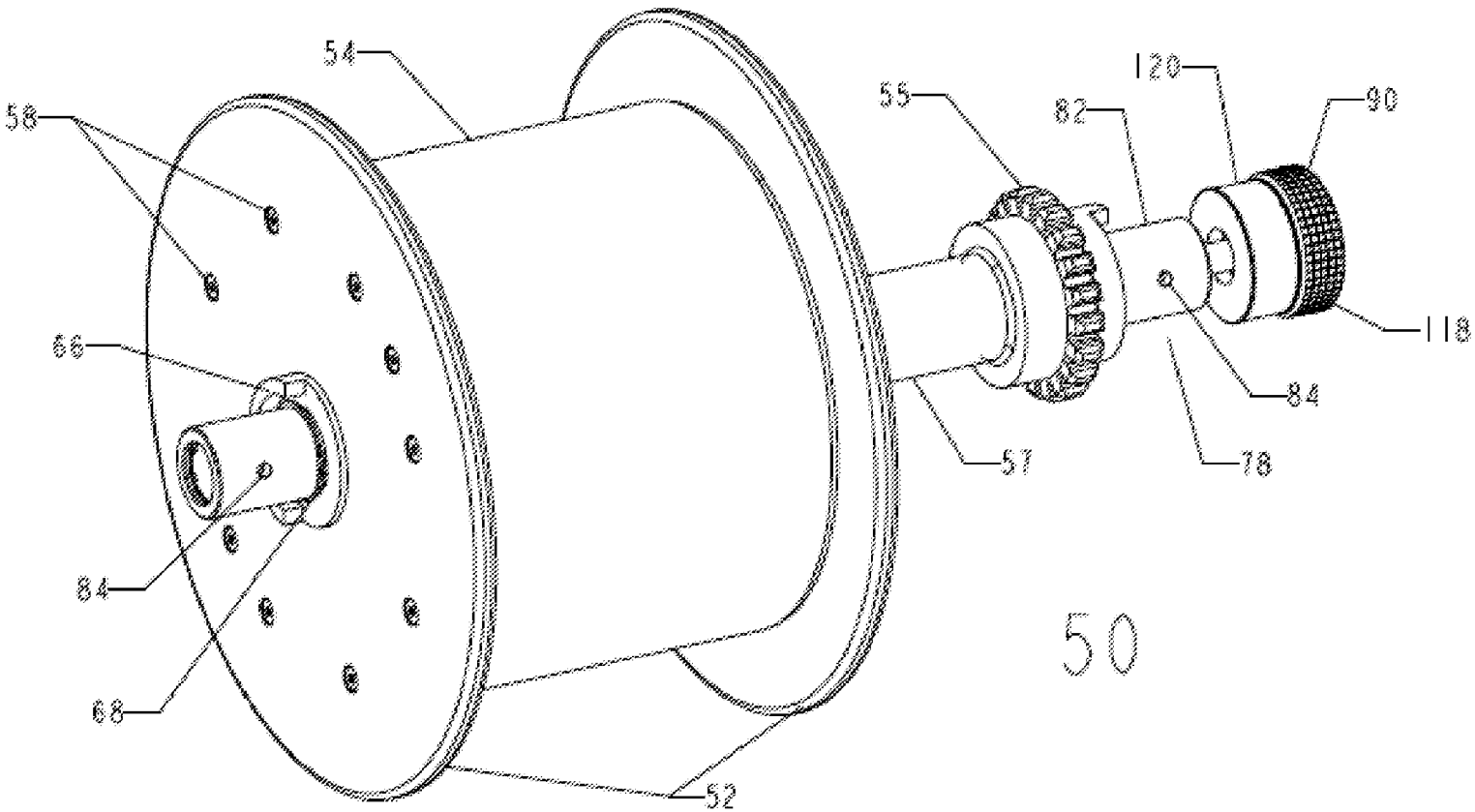
FIG. 4D is a perspective view of the rotating drum assembly for the wall-scaling simulator.
Figure 5A:
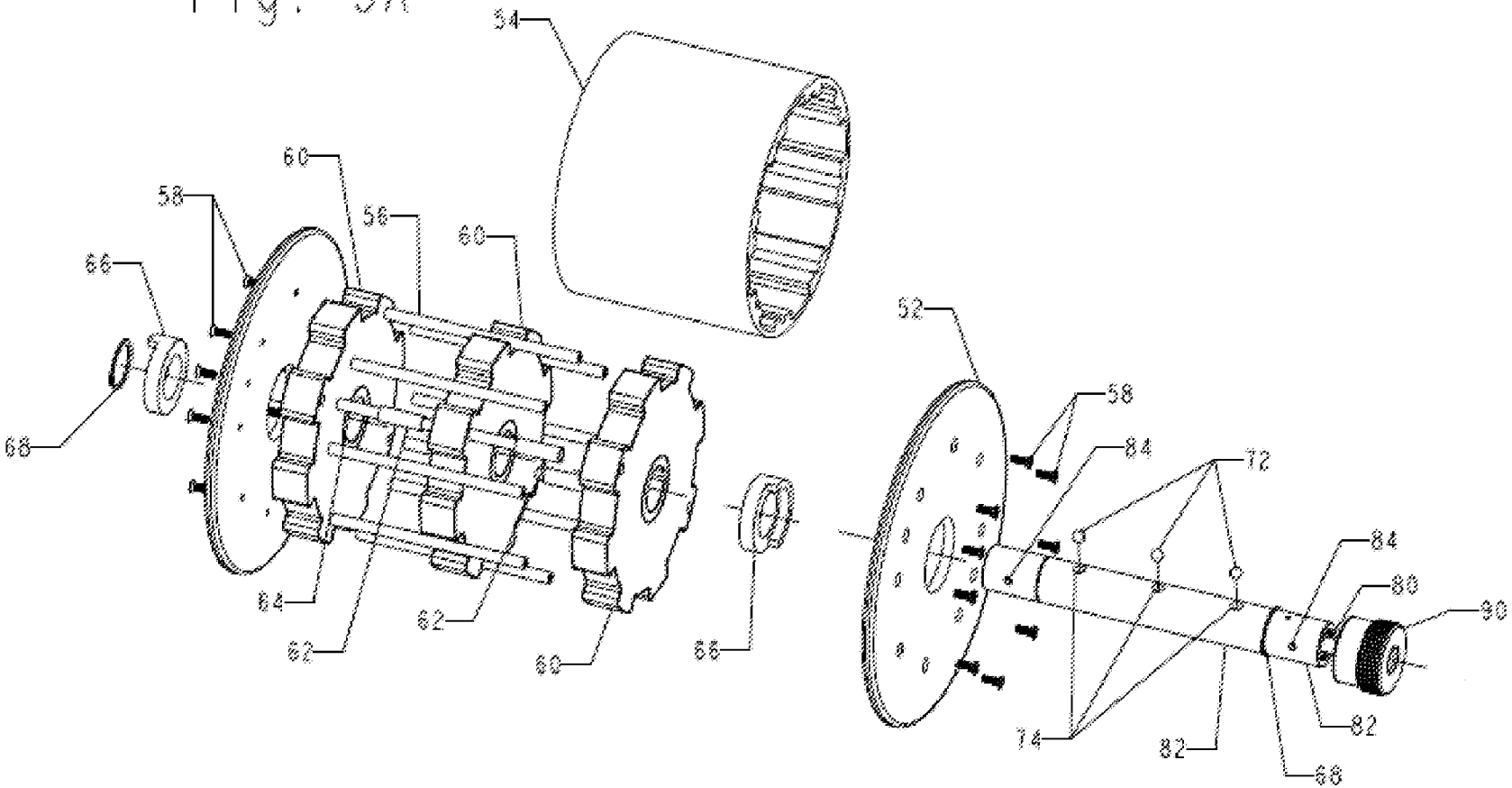
FIG. 5A is an exploded perspective view of the drum assembly for alternate embodiments of the invention.
Figure 5C:
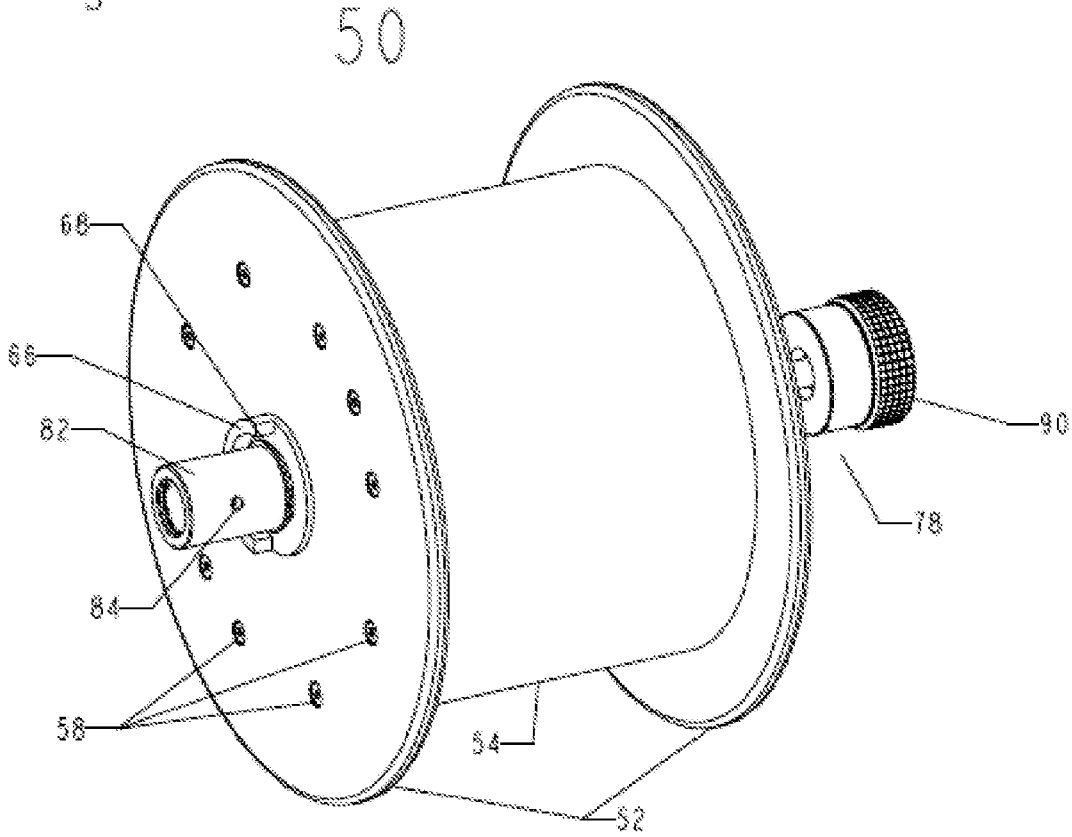
FIG. 5C is a perspective view of an assembled drum assembly for the alternate embodiments of the invention.
Figure 6A:
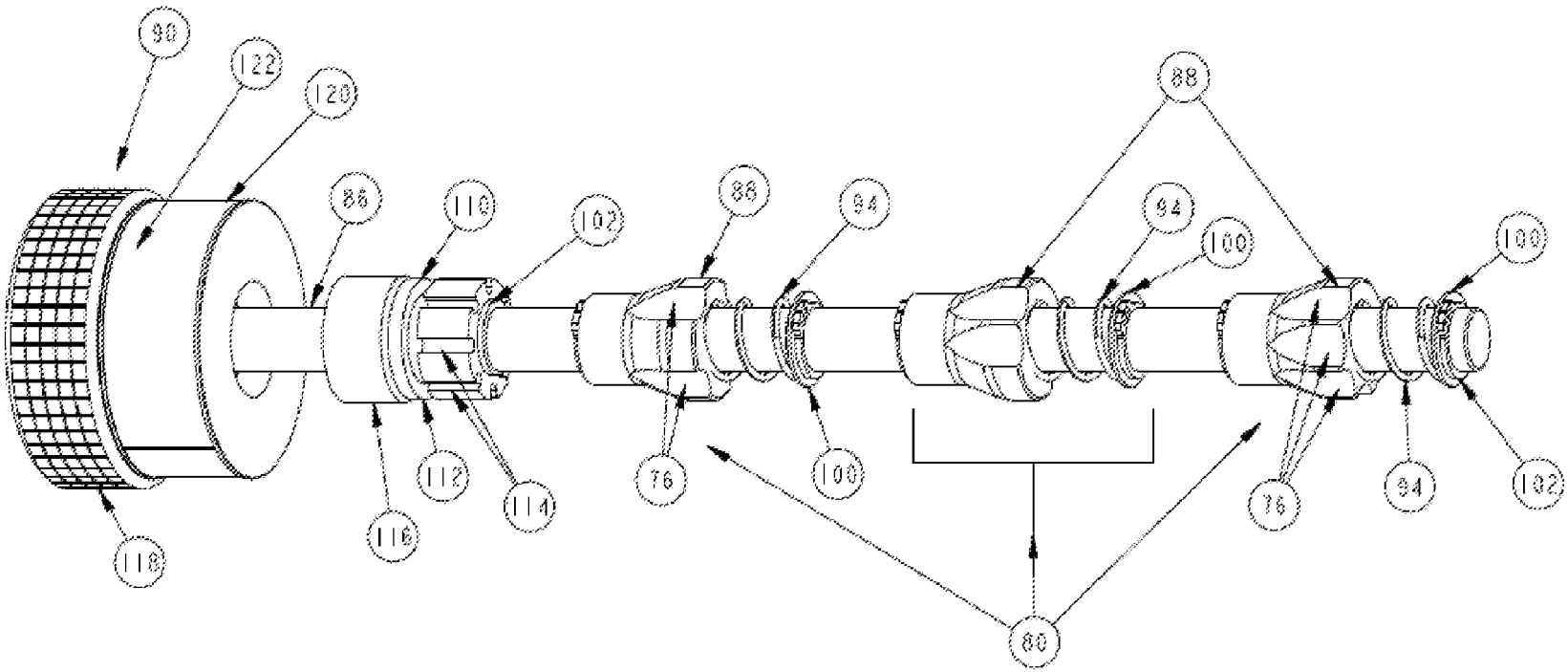
FIG. 6A shows the adjustment key mechanism.
Figure 6B:
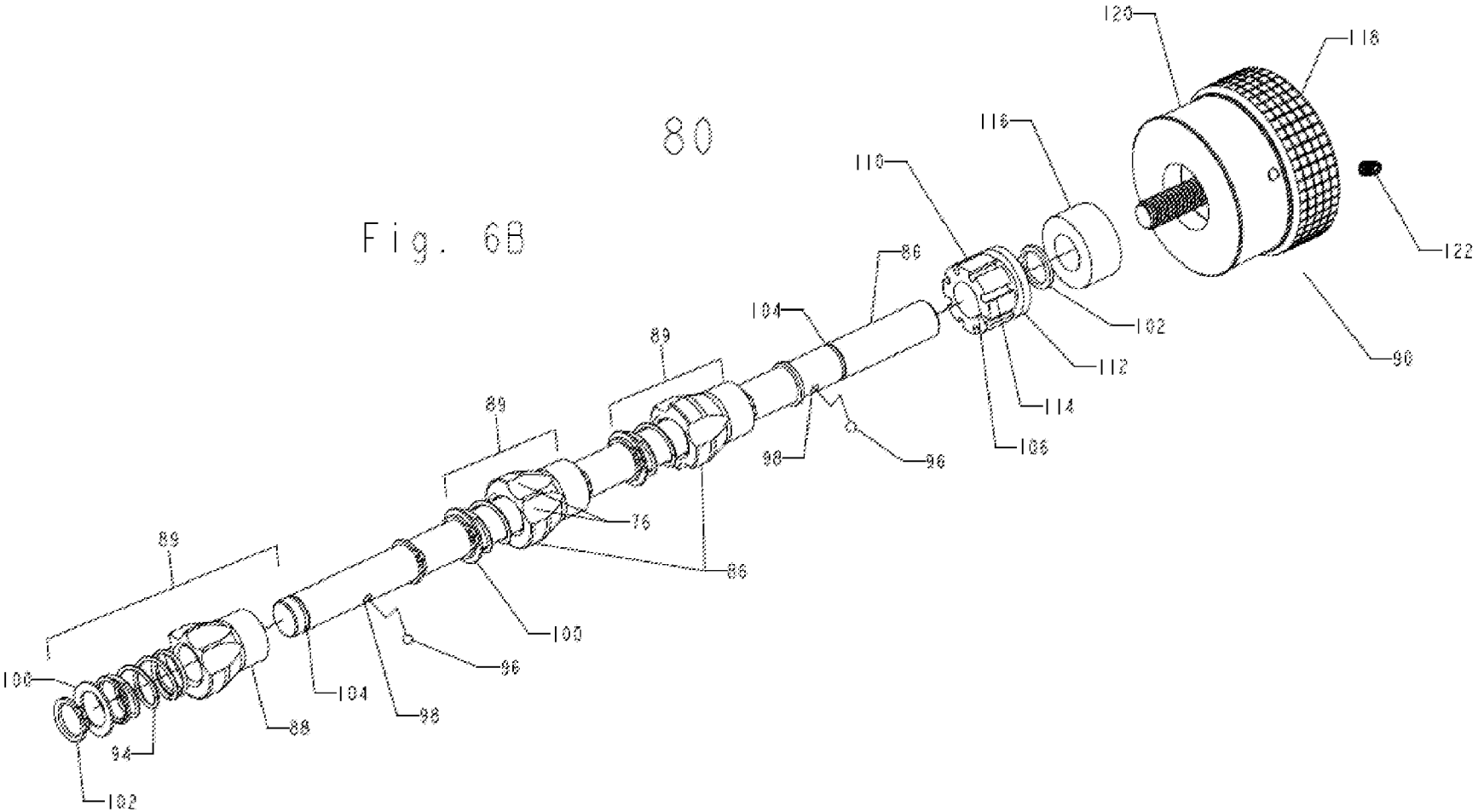
FIG. 6B is an exploded perspective view of the adjustment key mechanism.

Referring now to FIGS. 6A, 6B, and 4C, the adjustment key mechanism 80 is used to select the desired level of viscous resistance by engaging none, one, or more of the rotary viscous dampers 60. The central part of the adjustment key mechanism 80 is ideally a machined steel key assembly rod 86 with a threaded hole at the top end. A series of independent floating key mechanisms 89, one for each rotary viscous damper 60 are spaced evenly on the key assembly rod 86. Each floating key mechanism 89 is comprised of a tapered cylindrical adjustment key 88 that is loaded with a small adjustment key spring 94. The adjustment key springs 94 are held in place by washers 100 and snap rings 102 that snap into circumferential rod grooves 104 on the key assembly rod 86. A snap ring 102 installed in a circumferential rod groove 104 also limits the top ward movement of each key 88. Thus the snap rings 102 limit the compression and expansion action of each key 88 and spring 94.

Above the last floating key mechanism on the key assembly rod 86 is a cylindrical selector ring 110 that has one circumferential channel 112 around its outer surface such that it appears to have a cap on its top. The selector ring 110 also has lateral channels 114 on its outer surface, one corresponding to each resistance selection, spaced evenly around the selector ring 110, and extending from the bottom of the ring up to the circumferential channel 112. A snap ring 102 and rod groove 104 hold the selector ring in place. A nylon rod spacer 116 fits on the key assembly rod 86 above the snap ring 102 that secures the selector ring 110.

The adjustment key mechanism 80 also encompasses an adjuster knob assembly 90. The adjuster knob assembly 90 screws into the top of the key assembly rod 86. The adjuster knob assembly 90 is comprised of three pieces that can best be seen in FIGS. 4C and 6B. First, there is a round plastic adjuster knob 118 that can be purchased from any manufacturing supply company, such as part number 63625K91 from McMaster-Carr. The round adjuster knob 118 has a wider portion that can be grasped by the user and a narrower portion that holds an integrated threaded stud that fits into the threaded hole at the top end of the key assembly rod 86. Surrounding the narrower portion of the knob 118 is a steel knob cylinder 120 that adds heft to the adjuster knob assembly 90 and provides a surface on which the adjustment settings may be labeled. The cylinder has a threaded hole extending from its outer surface to its inner surface, and is held in place on the knob 118 by a knob set screw 122.

Thus, to summarize in order from bottom to top, the parts attached to the key assembly rod 86 of the preferred embodiment described here are three floating key mechanisms 89, each made up of a snap ring 102 followed by a washer 100, an adjustment key spring 94, an adjustment key 88, a second snap ring 102. On top of the third floating key mechanism rests a selector ring 110, another snap ring 102, the rod spacer 116, and finally the adjuster knob assembly 90.

The selector ring 110 as well as each key 88 are able to slide laterally along the key assembly rod 86, but are prevented from rotating circumferentially around the rod 86. The selector ring 110 and keys 88 have lateral hub channels 106 that run the length of their hubs. At each point along the key assembly rod 86 where a key 88 or the selector ring 10 fits, a small rod depression 98 has been machined into the rod 86. There is a single rod depression 98 corresponding to each key 88 and selector ring 110. One hemisphere of a small rod bearing 96 rests in each of the small depressions 98. The other hemisphere of the rod bearings 96 rides in the key or selector ring lateral hub channels 106. This allows the keys 88 and the selector ring 110 to move along the length of the key assembly rod 86, but not to rotate around the key assembly rod 86.

The keys 88 are fashioned in the general shape of a tapered cylinder, with the larger part of the taper on the bottom and the narrower part on the top. Each key is marked with eight positions, spaced equidistantly around the circumference of the key. In the preferred embodiment, each key has eight positions. Each position either has a lateral key depression 76 machined into the larger part of the taper, or no depression. A depression indicates that the corresponding rotary viscous damper 60 will not be engaged. No depression indicates that the corresponding rotary viscous damper 60 will be engaged.

The adjustment key mechanism 80, thus described, is loaded into the adjustment key shaft 82 with a shaft spring 92 at the bottom end of the shaft 82 that loads the adjustment key mechanism 80. The strength of the shaft spring 92 must be greater than the combined strength of the adjustment key springs 94. Pressure may be applied on the adjustment key mechanism 80 to push it into the adjustment key shaft 82, which compresses the large spring. The spring will then exert pressure to push the adjustment key mechanism 80 out of the adjustment key shaft. A selector locking pin 124 (visible only in FIG. 4C) is embedded in the wall of adjustment key shaft 82 at the point where the selector ring 110 sits on key assembly rod 86.

When the adjustment key mechanism 80 is in its resting position, i.e., pushed to its outermost position by the shaft spring 92, the selector locking pin 124 sits in one of the selector ring lateral channels 114 and the adjustment key mechanism 80 cannot be rotated circumferentially. This position corresponds to one of the eight possible resistance adjustments that the three dampers 60 of the preferred embodiment allow. An alternate position may be selected by pushing the adjustment key mechanism 80 against the shaft spring 92, which causes the selector locking pin 124 to align with the selector ring circumferential channel 112. At that point, the adjustment key mechanism 80 may be rotated to select an alternate selector ring lateral channel 114, thereby selecting an alternate damper resistance adjustment. When the user releases the compression pressure on the shaft spring 92, the spring pushes the adjustment key mechanism 80 back out, locking it into the newly selected selector ring lateral channel 114 and preventing additional circumferential rotation of the mechanism.

The above-described adjustment motion causes the floating key mechanisms 89 to engage with the rotary dampers 60 in the following manner:

The adjustment key shaft 82 has an adjustment key shaft bearing hole 74 (visible only in FIGS. 4A and 5A) aligned with the hub of each of the rotary dampers 60. A key bearing 72 rests in each bearing hole 74. When the adjustment key mechanism 80 is pushed in, rotated, and released, the independent floating key mechanisms 89 rotate along with the key assembly rod 86. The keys 88 align with the key bearings 72 resting in the adjustment key shaft bearing holes 74. If the floating key mechanism 89 is circumferentially rotated such that a position with a lateral key depression 76 is aligned with the key bearing 72, then the key bearing 72 will rest in the lateral key depression 76, and not be forced upward through the shaft bearing hole 74 to engage with its corresponding damper engagement notch 64. If, alternatively, the floating key mechanism 89 is circumferentially rotated such that a position without a lateral key depression 76 is selected, then the floating key mechanism 89 will remain loaded on its adjustment key spring 94 and be unable to return to its resting position until the drum apparatus 50 rotates and the damper engagement notch 64 is aligned with the key bearing 72 and shaft bearing hole 74. At the point of engagement the adjustment key spring 94 will be able to push the key 88 back to its resting position with spring 94 extended, and the key bearing 72 will be forced through the shaft bearing hole 74 and into the damper engagement notch 64. One hemisphere of the bearing 72 will lie in the damper engagement notch 64, and one hemisphere will lie in the adjustment key shaft 82, thus locking the damper 60 to the shaft and engaging it. The lateral key depressions 76 are arranged on the keys such that the eight resistance levels discussed above that can be achieved by using three rotary viscous dampers 60. For example, when all three keys 88 are aligned with lateral key depressions 76 facing the shaft bearing holes 74, then no dampers are engaged. When all three keys 88 are aligned without lateral key depressions 76 facing the shaft bearing holes 74, then all three dampers are engaged. Thus, in FIG. 6A, if the damper engagement notches 64 are aligned with the face of the adjustment key mechanism 80 directly facing our view, then the damper 60 closest to the adjuster knob assembly 90 will be engaged, the middle damper 60 will not be engaged, and the damper 60 closest to the end of the key assembly rod 86 will not be engaged.

It is to be understood that the drum assembly 50, endless cord 48, and adjustment key assembly 78 described above are attached identically to the fork member 40, and operate identically in all embodiments of the invention, and reference to the above description should be made to understand the operation of each of the preferred embodiments described in this description.

The benefits enabled by the present machine are many. The endless cord exercise machine that allows the user to simulate the act of scaling a wall with the assistance of a cord introduces a new, fun, and physically challenging experience to the gym. Rope-climbing simulator machines have been growing in popularity, and this machine builds on that success, while also adding a lower-body conditioning element to the exercise. Wall scaling with a cord not only builds strength, but also develops balance and agility. The military continues to use wall-scaling exercises in its training, and a machine of this type could help the military to intensify the use of such training in a much smaller space. The machine allows the user to build the same kinds of physical skills as real wall scaling, but presents the user with an "infinite wall," not limited by the constraints of the physical wall height at a training location.

Second, as employed in the present invention the combination of an endless cord and movable belt with rotary viscous dampers provides the user with a continuous resistance for upper body muscle development. Although there are many examples of continuous motion exercise machines for lower body development, such as exercise bicycles and treadmills, there are very few for upper body development. In the present invention, pulling on the cord provides the user with continuous muscle resistance in one direction and no stored energy is created. This is very different from the typical universal weight machine used for upper body conditioning, where the muscle must be flexed to lift the weight, and then flexed in the opposite direction to return the weight to its resting position. The endless cord exercise machine requires no such opposite return motion. The result is a sustained focus on one specific muscle group at a time.

In addition, rotary viscous dampers provide passive feedback. They automatically match the force exerted by the user and no resistance is required to disengage the mechanism. The user simply stops the pulling action. Many of the injuries sustained by users on typical weight resistance exercise machines occur when the weight is being released, either because too much strain is exerted on the muscle and connecting tissues, or because the weight mechanism itself is too-quickly released in a dangerous manner. With rotary viscous dampers, there is no weight to release. Rather, the user must exert force in the opposite direction to return the mechanism to its original position. Thus, the present invention does not suffer from the drawbacks of resistance mechanism that do not use passive feedback, thus providing the user with a superior exercise experience.

Furthermore, in addition to the adjustable resistance settings created by using multiple dampers together, the physical properties of rotary viscous dampers are such that the resistance varies by speed of rotation. The faster the user pulls on the cord and rotates the drum, the greater the resistance the user will encounter. This means that as a user's muscles are strengthened, the user may increase pulling speed to increase the amount of resistance.

Using the machine is very simple. In any embodiment of the machine, first the user selects the desired resistance setting by pushing in on the adjustment key mechanism 80 and rotating it to the desired resistance setting. The user then stands on the safety pad 31 facing and just in front of the movable belt assembly 21. The user grasps the portion of the cord 48 that is coming off the two upper pulley wheels 142, and beings to pull the cord 48 in a hand over hand motion. Pulling the cord 48 rotates the resistance mechanism 50, which in turn rotates the movable belt 23. Grasping the cord 48 while leaning back and continuing to pull, the user then begins walking up the movable belt 23. If the user's body descends to the safety mat 31 before the user is walking on the movable belt 23, then the resistance mechanism 50 must be set to a higher resistance level. If the user is unable to advance the cord 48 as quickly as desired, then the resistance mechanism 50 must be set to a lower resistance level. The resistance and speed at which the user pulls determines the type of muscle and cardiovascular benefit the user gains. This method of use provides an exercise experience and benefit similar to that of scaling a wall with the assistance of a rope, without the disadvantages of having a rope or wall of limited length or the dangers of falling from a height or receiving a harsh rope burn.

The user may also use the exercise machine to simulate descending a wall, by pulling the cord 48 from the section that comes off the two lower pulley wheels 142. This will cause the rotating drum assembly 50 and the movable belt 23 to rotate in the opposite direction, and the user can walk backwards down the movable belt 23. However, in this case the user's arms will continue to pull in the downward direction as when the user is simulating an ascent of the wall.

Various other cord-pulling exercises may be performed on the machine without making use of the movable belt 23. For instance, the user may stand facing the movable belt assembly 21 with hands raised above the head and pull the cord 48 overhead in a front to back direction. The user may also turn facing away from the movable belt assembly 21, and pull the cord 48 overhead in a back to front direction. Alternatively, a tread gear release switch (not shown) may be installed, allowing the user to disengage the movable belt 23 and then brace the user's legs against the disengaged movable belt 23 and engage in cord-pulling exercises only. This latter position provides an exercise experience and benefit similar to that of rope climbing, without the disadvantages of having a rope of limited length or the dangers of falling from a height or receiving a harsh rope burn.

While the primary embodiment of the invention is for a wall-scaling simulator, removing the movable belt assembly 21 and arranging the resistance mechanism 50 and frame 20 in alternate positions allows for a number of additional embodiments (shown in FIGS. 2A, 2B, 3A, 3B, 3C, 7A, 7B, and 8) as an endless cord pulling exerciser or rope climbing simulator. Since there is no movable belt 23, it is preferable that these other embodiments use a modified rotating drum assembly 50 (shown in FIGS. 5A, 5B, and 5C) that does not have the drum gear connector assembly 57. Accordingly, a shorter adjustment key assembly 78 is also preferably used to fit this modified rotating drum assembly 50.

Figure 2A:
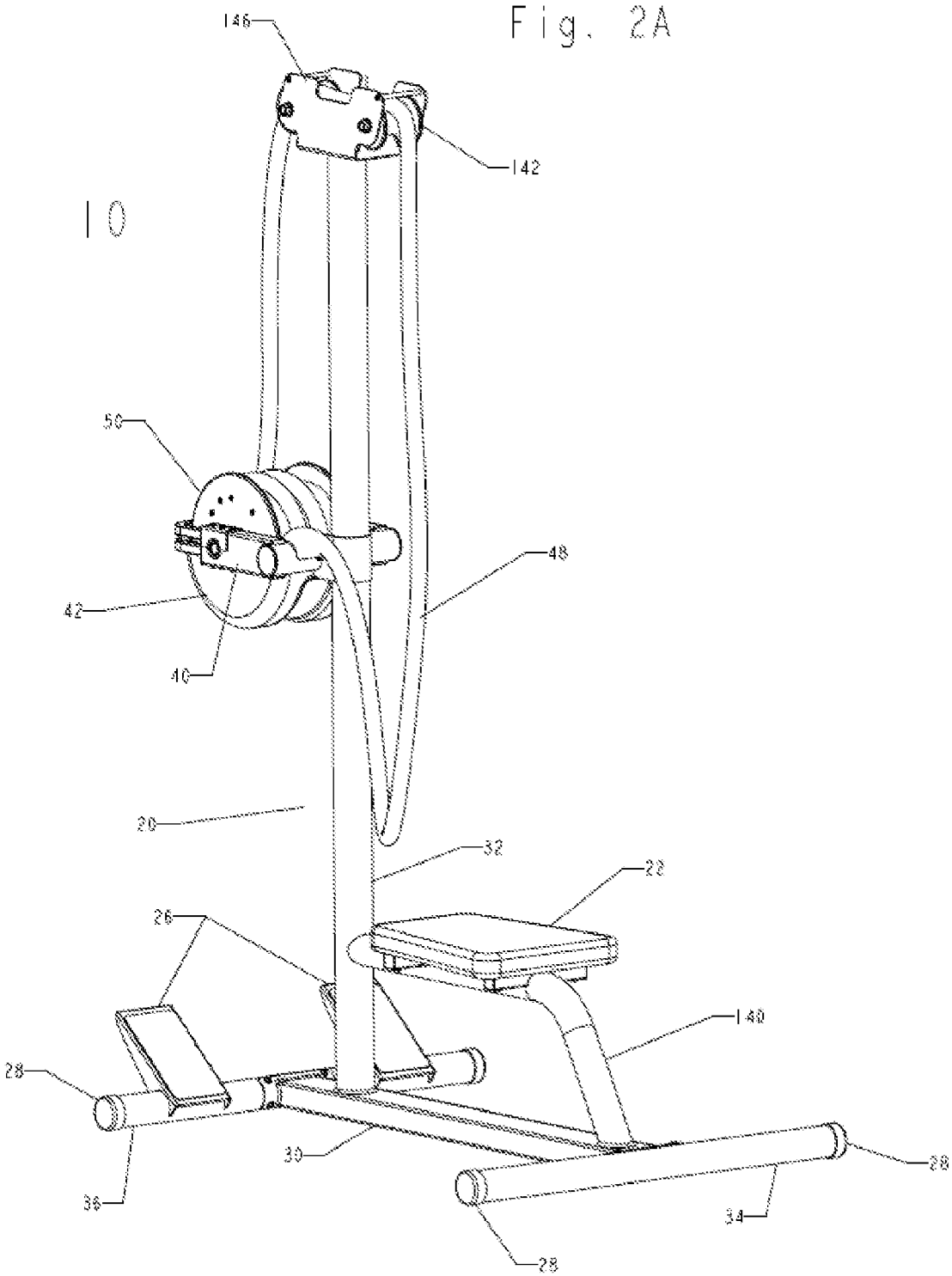
FIG. 2A is a perspective view from the front of another embodiment of the exercise machine, in which the user starts from a seated position.
Figure 2B:
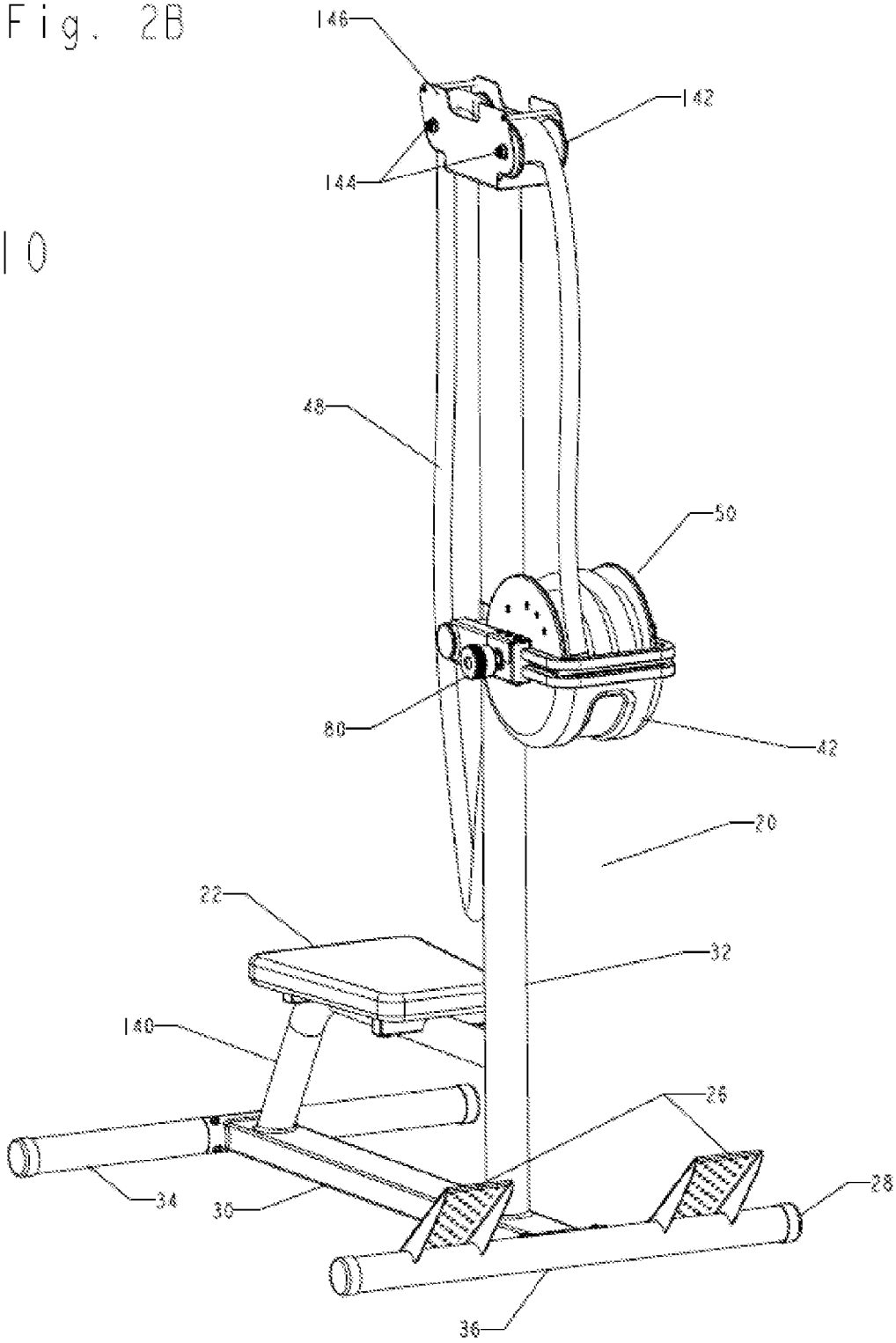
FIG. 2B is a perspective view from behind of another embodiment of the exercise machine, in which the user starts from a seated position.

FIGS. 2A and 2B show a second preferred embodiment of the exercise machine 10, designed to allow a user to operate the machine seated on a bench at chair height. In this embodiment the frame 20 has a single horizontal base member 30, and a first and second horizontal support member 34, 36 that are attached perpendicularly to each of the horizontal base member's 30 ends to provide stability. The vertical support member 32 extends upward at 90 degrees to the horizontal members 30, 34, 36. A bench support member 140 extends upward from the horizontal base member 30 and curves toward the vertical support member 32 in order to support a bench 22, which is mounted upon it, at a sitting height that would be comfortable to a user of the exercise machine. The bench 22 may be padded to provide the user with additional comfort. A set of foot rests 26 is mounted on the second horizontal support member 36, at a spacing and angle as would be comfortable to a user seated on the bench 22. Rubber, foam, or plastic frame end caps 28 may be placed on the ends of the horizontal support members 34, 36 to cover potentially sharp edges, to provide a grip on hard floors, and to prevent scratching of hard floors. In this embodiment, the fork member 40 and rotating drum assembly 50 are located halfway up the vertical support member 32. The cord 48 comes off the drum assembly 50 and is looped over two free-spinning cord support pulleys 142 attached with pulley axles 144 to a pulley support member 146 mounted at the top of the vertical support member 32.

To use the machine, first the user selects the desired resistance setting by pushing in on the adjustment key mechanism 80 and rotating it to the desired resistance setting. The user then sits on the bench 22 with legs straddling the vertical support member 32 and feet resting on the foot rests 26. The user then reaches up and pulls down on the portion of the cord 48 that hangs down from the cord support pulleys 142 in a hand-over-hand motion. If the resistance of the rotating drum assembly 50 is set high enough relative to the weight of the user, then the user can pull the user's body off the bench 22, and experience the feeling and benefit of true rope climbing.

The cord 48 can only be pulled in one direction. However, for an alternate exercise the user may also sit on the bench facing either toward or away from the vertical support member 32 with arms above the head and pull the cord 48 in hand-over-hand motion. The resistance and speed at which the user pulls determines the type of upper body muscle and cardiovascular benefit the user gains. This embodiment is especially well suited for elderly or disabled users, but can be used by anyone, and is also the version that most closely replicates actual rope climbing, since the cord is pulled straight down from overhead.

Figure 3A:
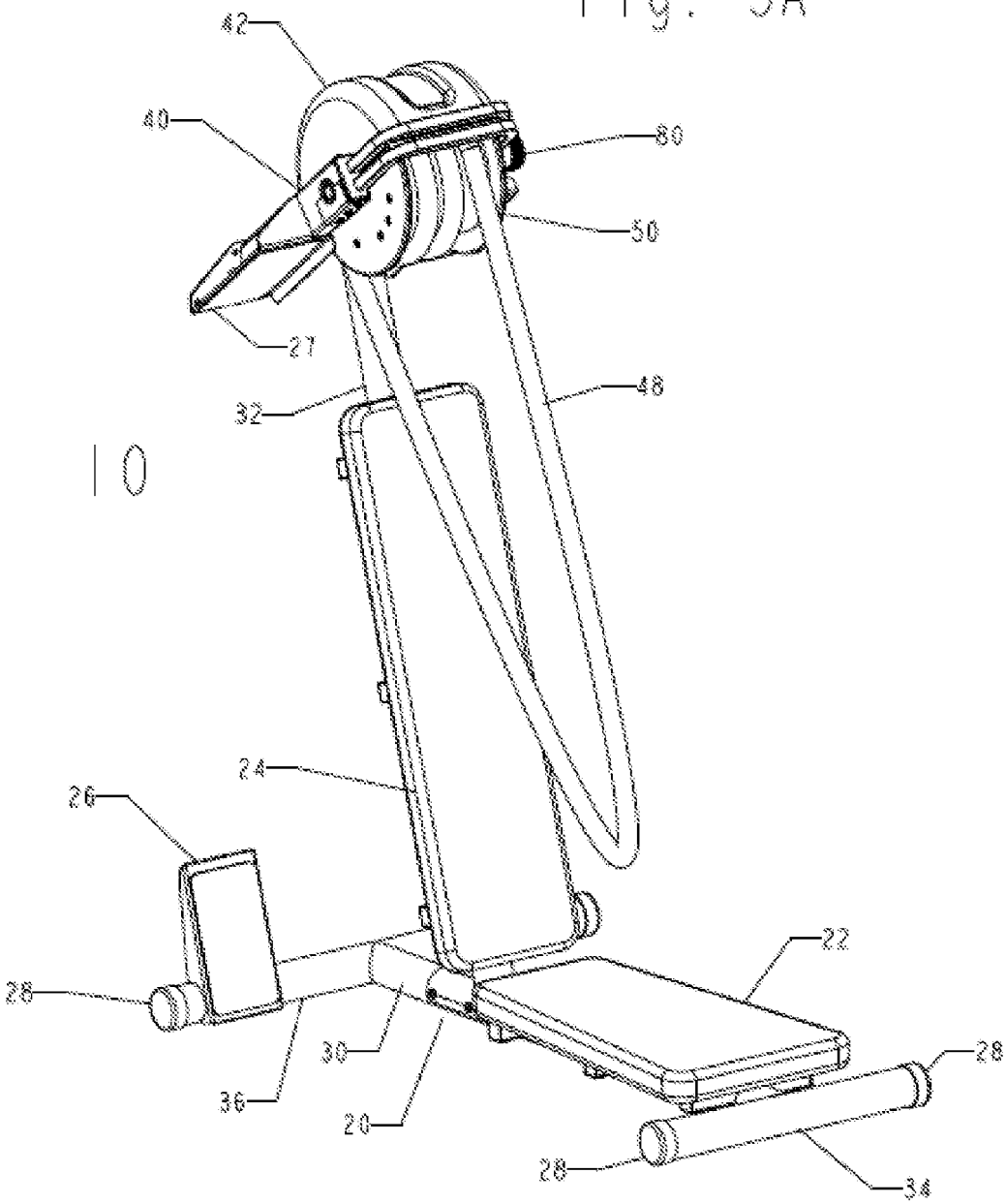
FIG. 3A is a perspective view from the front of a preferred embodiment of the exercise machine in its upward position.
Figure 3B:
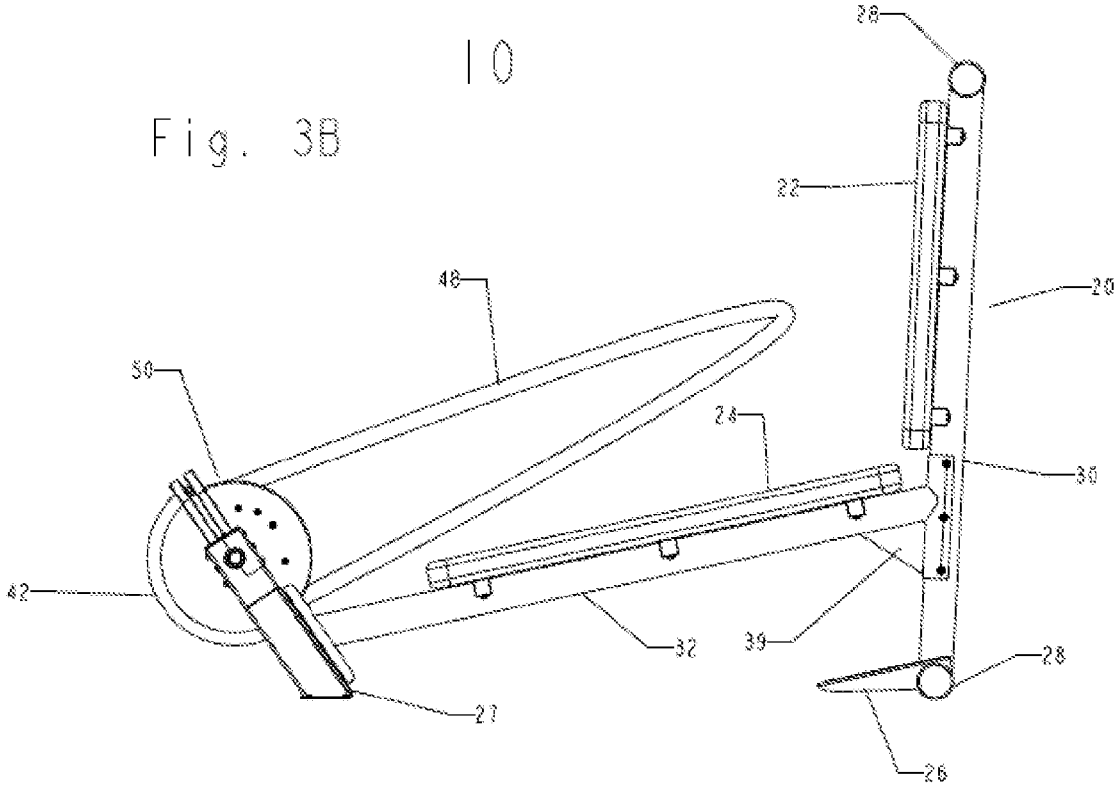
FIG. 3B is view from the side of a preferred embodiment of the exercise machine in its downward position.
Figure 3C:
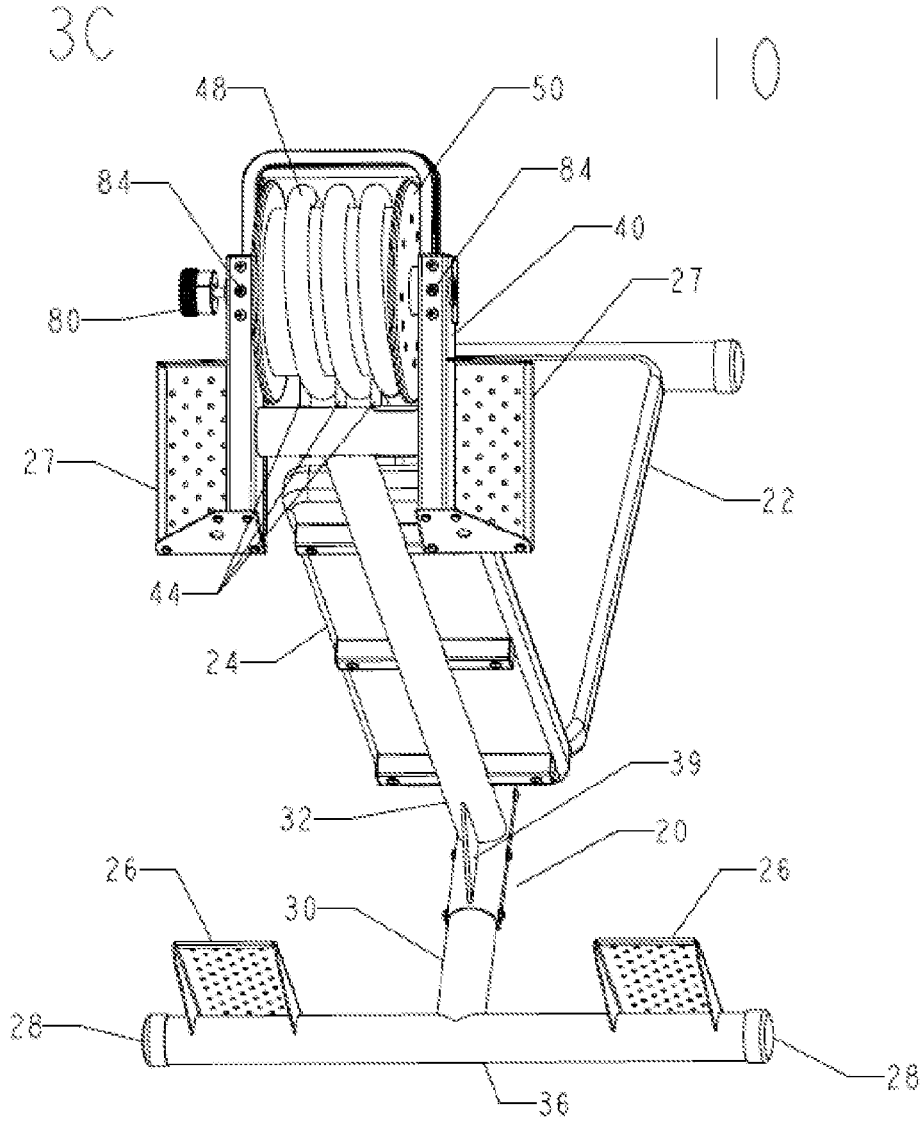
FIG. 3C is a perspective view from behind the drum assembly of a preferred embodiment of the exercise machine.

Referring now to FIGS. 3A-3C, another preferred embodiment of the exercise machine invention 10 is shown that can be oriented in two different ways and provides the user with a number of cord-pulling exercise activities. This version of the machine is compact and lightweight, thus ideal for tight spaces.

Described in its upright position (FIG. 3A), the exercise machine 10 comprises a frame 20 made up of a horizontal base member 30 and a vertical support member 32. Attached perpendicularly to each end of the horizontal base member 30 are a first horizontal support member 34 and a second horizontal support member 36 that stabilize the frame. The second horizontal support member 36 must be long enough to provide the machine with stability in either the upright or downward position. The vertical support member 32 is attached to the horizontal base member 30 at a point closer to the second horizontal support member 36 than to the first horizontal support member 34. The vertical support member 32 extends upward in a plane perpendicular to the plane created by the horizontal base member 30 and the horizontal support members 34, 36, at an angle of approximately 105 degrees to the horizontal base member 30, such that the top of the vertical support member 32 is nearly directly above the intersection between the horizontal base member 30 and the second horizontal support member 36. Although these angles are ideal, others may be used as found useful by one skilled in the art of exercise equipment. A triangular-shaped frame stiffening gusset 39 is mounted at the joint between the horizontal frame member 30 and the vertical frame member 32 to provide additional support, as these frame members 30, 32 are relatively long and the joint they form bears much of the stress exerted by the user on the frame 20.

Mounted to the horizontal base member 30 of the frame is a first bench 22 on which the user can sit or recline when the frame 20 is oriented in its upright position as shown in FIG. 3A. A second bench 24 is mounted to the vertical support member 32, on which the user can sit or recline when the frame 20 is oriented in its downward position as shown in FIG. 3B. When the frame 20 is oriented in its downward position, the first bench 22 may serve as a backrest for the user seated on the second bench 24. The benches 22, 24 may be padded to provide the user with additional comfort. Rubber, foam, or plastic frame end caps 28 may be placed on the ends of the horizontal support members 34 and 36 to cover potentially sharp edges, to provide a grip on hard floors, and to prevent scratching of hard floors. The frame 20 is also fitted with two sets of footrests 26 and 27. The first set of footrests 26 is mounted near the extremities of the second horizontal support member 36 that may be used when the frame is oriented in its upright position as shown in FIG. 3A. The second set of footrests 27 is mounted on either side of fork member 40 and may be used when the frame is oriented in its downward position as shown in FIG. 3B. Mounted at the top end of vertical support member 32 is an H-shaped fork member 40 that holds the rotating drum assembly 50, best visible in FIG. 3C, which shows the preferred embodiment from the backside.

As with other embodiments of the exercise machine, first the user selects the desired resistance setting by pushing in on the adjustment key mechanism 80 and rotating it to the desired resistance setting. When the machine is in its upward position as shown in FIG. 3A, the user may assume any of several positions and grasp the portion of cord 48 that comes off the top of the rotating drum assembly 50. The user may straddle the first bench 22 in a standing position facing the vertical support member 32 and pull down on the cord 48 in a hand-over-hand motion. The user may also turn around and the pull the cord 48 overhead using the same motion. While facing away from the vertical support member 32, the user may sit on the first bench 22 with the user's back resting against the second bench 24 and then pull on the portion of the cord 48 coming off the bottom of the drum assembly 50 with hands raised above the users head. Alternatively, the user may brace the user's feet against the first set of foot rests 26 and sit on the first bench 22, again pulling on the cord 48 in a hand-over-hand motion. For maximum benefit instead of sitting the user may select a stronger resistance level and then attempt to stay balanced and suspended over the first bench 22 while pulling on the cord 48. This latter position provides an exercise experience and benefit similar to that of rope climbing. Regardless of the user's position, the resistance and speed at which the user pulls determines the type of upper body muscle and cardiovascular benefit the user gains.

The machine offers alternate exercise options when it is oriented in its downward position as depicted in FIG. 3B. In this position the user can sit on second bench 24 with back resting against first bench 22 and feet resting on the second set of foot rests 27. The user then pulls the cord 48 inward toward the user's stomach as in a tug of war.

Figure 7A:
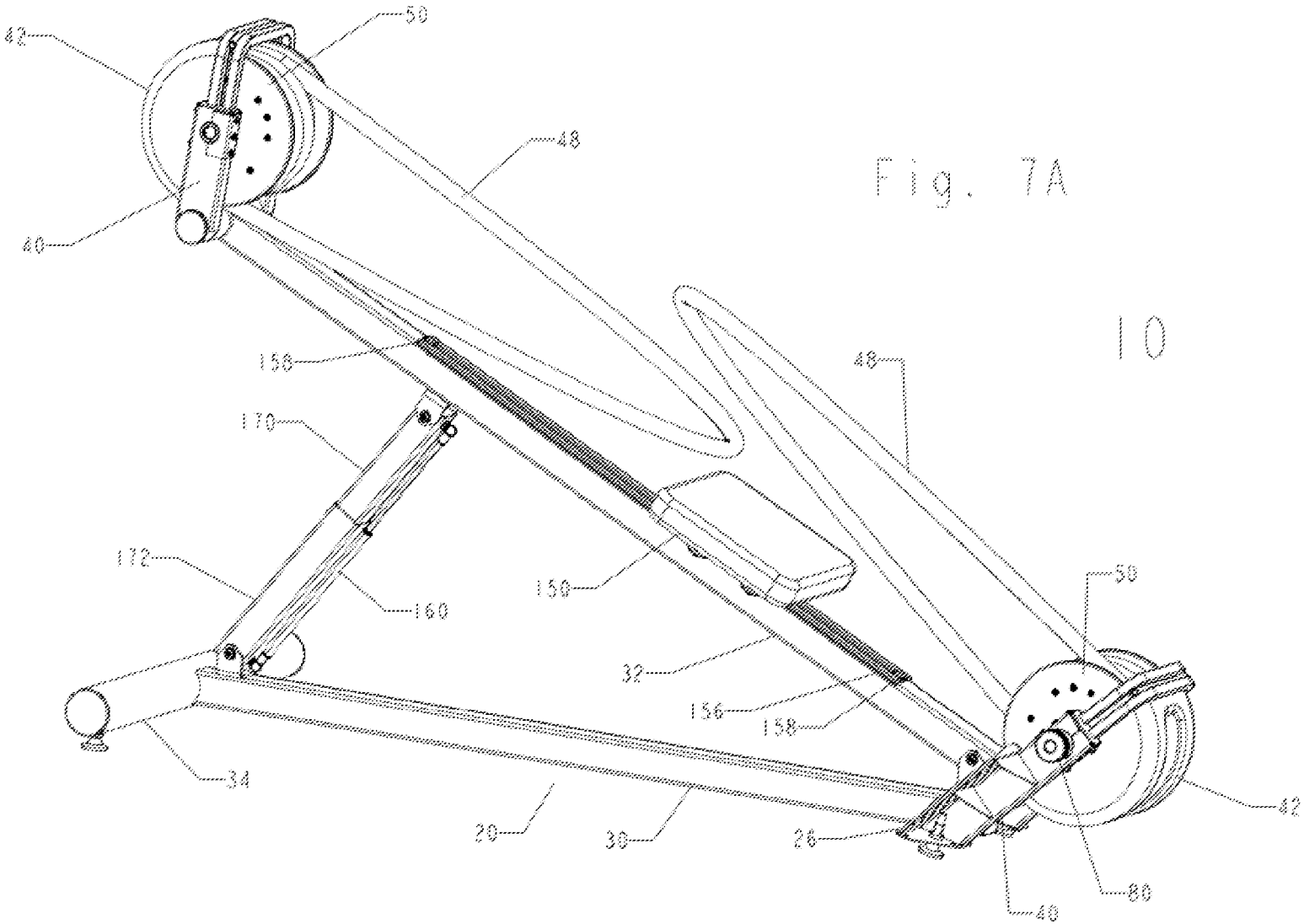
FIG. 7A is a perspective view from the side of a preferred embodiment of the exercise machine with a sliding bench and two rotating drum assemblies.
Figure 7B:
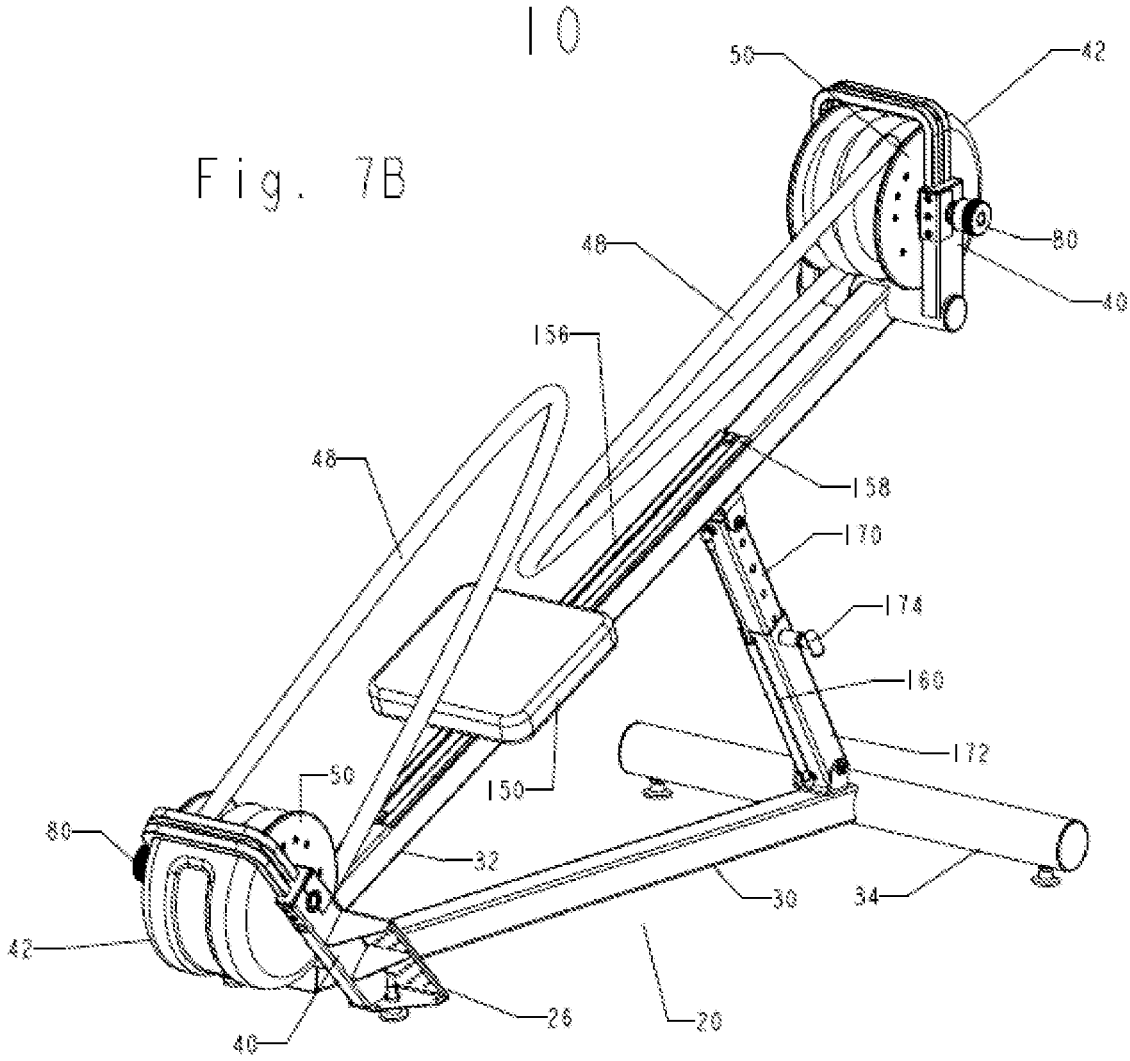
FIG. 7B is a perspective view from behind of a preferred embodiment of the exercise machine with a sliding bench and two rotating drum assemblies.

In another preferred embodiment as shown in FIGS. 7A and 7B the machine 10 has two rotating drum assemblies 50, two cords 48, and a sliding bench 150 allowing the user to simulate pulling the user's body up a hill, or to exercise lower body muscles by employing the user's legs to push the user up and incline away from the drum. The frame 20 of this version has a horizontal base member 30 attached to a horizontal support member 34 at one end. At the other end, the horizontal base member 30 is attached by a hinge to a vertical support member 32. Along the top of the vertical support member is mounted a bench track 156. A female frame adjustment support member 172 is hinged to the horizontal base member 30 at its junction with the horizontal support member 34. A male frame adjustment support member 170 that fits inside the female frame adjustment support member 172 is hinged to the vertical support member 32 at a point underneath and near the top end of the bench track 156. The female frame adjustment support member 172 has a hole punched near the top, and the male frame adjustment support member 170 has a series of holes spaced along its length. A frame adjustment pin 174 that fits the holes of the male and female adjustment support members 170 and 172 is used to lock the male and female adjustment support members 170 and 172 together, thereby allowing the inclination of the vertical support member 32. Attached to the underside of the male and female adjustment members 170 and 172 is a gas spring 160 to assist in raising and lowering the inclination of the vertical support member 32.

A sliding bench 150 glides on bench wheels 154 surrounding the bench track 156. The sliding bench 150 moves along bench track 156 up and down the top surface of the vertical support member 32. A track bumper 158 located at either end of the bench track 156 limits the movement of the sliding bench 150 along the vertical support member 32. U-shaped fork members 40 are positioned at both ends of the vertical support member 32 and a rotating drum assembly 50, around which is wrapped an endless cord 48, is fastened to each fork member 40 in the same manner as for embodiments described above. Footrests 26 are attached to either side of the fork member 40 that holds the lower rotating drum assembly 50.

The embodiment of the invention shown in FIGS. 7A and 7B can be operated in at least two ways. The first method primarily exercises leg and back muscles. The user sits on the sliding bench 150 facing the lower drum assembly 50 with legs bent and feet against the footrests 26. The user leans forward and grasps the cord 48 firmly with both hands. The user then pushes against the footrests 26 to straighten legs, and leans back slowly, causing the drum assembly 50 to rotate. The user then allows gravity to return the user back to the starting position while reaching for a new position on the cord 48. The user repeats this motion, similar to that of rowing, over and over until the desired amount of exercise is gained. The drum can be adjusted by selecting a desired level of resistance using the adjustment key mechanism 80.

The second method for operating the embodiment shown in FIGS. 7A and 7B exercises the arms. The user sits straddling the sliding bench 150, facing the upper drum assembly 50 with the user's legs hanging down from the bench 150, and then pulls on the cord 48 with a hand over hand motion to slide the bench 150 up the incline toward the drum 50. Additional footrests (not shown) may be added to accommodate the user's feet in this position. Gravity causes the user and the bench 150 to slide back down the incline and the user must continue to pull the cord 48 in order to continue the up and down sliding motion. The user may also pull the cord 48 and attempt to stay stationary, using the drum assembly 50 resistance to balance between the user's weight and the gravitational pull.

Adjusting the angle of the vertical support member 32 using the male and female adjustment support members 170 and 172 and the frame adjustment pin 174 changes the dynamics of the weight resistance. The steeper the angle, the more force the user must exert to rotate the lower drum assembly 50, or the faster the user must pull against the upper drum assembly 50 to keep from sliding back down the vertical support member 32 on the sliding bench 150.

Figure 8:
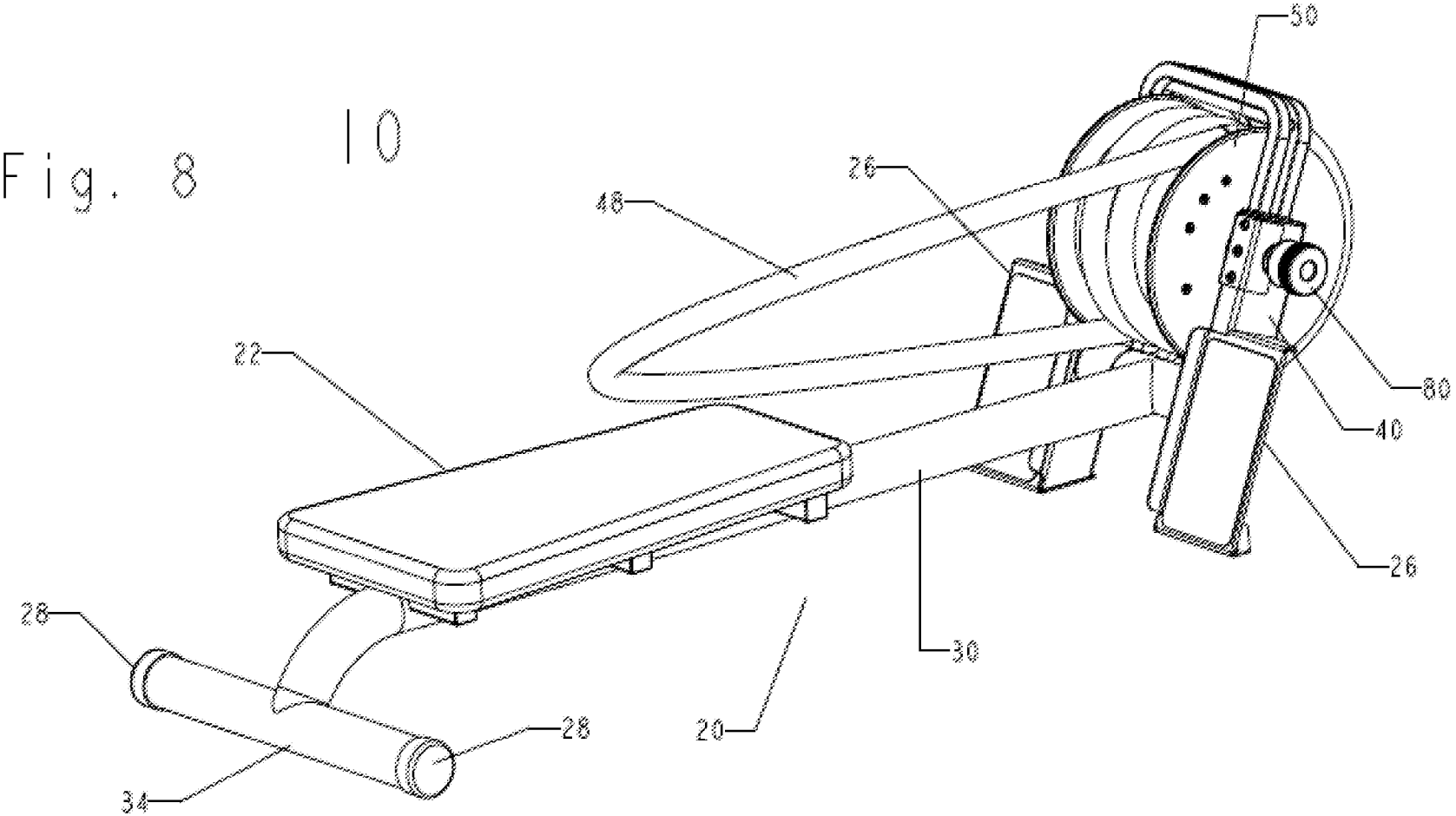
FIG. 8 is a perspective view of a compact version of the exercise machine.

In another preferred embodiment as shown in FIG. 8 the frame 20 of the exercise machine 10 comprises the horizontal base member 30, a horizontal support member 34 with frame end caps 28 at one end of the machine, and integrated footrests 26 to support the frame 20 at the other end. The frame 20 is oriented substantially horizontally with the fork member 40 mounted in between the footrests 26. The fork member 40 holds the rotating drum assembly 50, around which is wrapped an endless cord 48. A bench 22 is positioned along the horizontal base member 30 at the opposite end.

The user operates the machine by selecting a desired resistance using the adjustment key mechanism 80 and then pulling the cord 48 inward toward the user's chest and stomach using a hand over hand motion.

As mentioned above, fork member 40, the rotating drum assembly 50, and the adjustment key assembly 78 may also be used without a frame by mounting the fork on a pre-existing stable structure, such as a wall or doorway. The rotating drum assembly 50 and adjustment key assembly 78 can also be used in any application where adjustable rotary resistance is required. The fact that the only moving parts on the invention are located in the rotating drum assembly 50 help to reduce the cost of manufacture as well as the cost of ownership, since there is very little to wear out.

While various embodiments of the present invention have been described above, it should be understood that they have been presented by way of example only, and not limitation. This is true of design elements, materials described, as well as uses of the machine. Thus, the breadth and scope of the present invention should not be limited by any of the above-described exemplary embodiments.

PARTS LIST

10 Exercise machine invention
20 Frame
21 Movable belt assembly
22 First bench
23 Movable belt
24 Second bench
25 Drive belt
26 First set of foot rests
27 Second set of foot rests
28 Frame end caps
29 Belt rollers
30 Horizontal base member
31 Safety mat
32 Vertical support member
33 Movable belt deck
34 Horizontal support member
36 Second horizontal support member
37 Horizontal drum support member
38 Movable belt support frame
39 Frame stiffening gusset
40 Fork member
41 Transmission mechanism
42 Drum cover
44 Cord bearing components
48 Endless cord
50 Rotating drum assembly
52 End plates
54 Drum
55 Drum gear
56 Connector pipes
57 Drum gear connector assembly
58 Fasteners
60 Rotary viscous dampers
62 Damper spacers
64 Damper engagement notches
66 Drum bushing
68 Drum bushing snap rings
72 Key bearings
74 Adjustment key shaft bearing holes
76 Lateral key depression
78 Adjustment key assembly
80 Adjustment key mechanism
82 Adjustment key shaft
83 Belt roller gear
84 Fork pins
86 Key assembly rod
88 Adjustment key
89 Floating key mechanisms
90 Adjuster knob assembly
92 Shaft spring
94 Adjustment key springs
96 Rod bearings
98 Rod depression
100 Washers
102 Snap rings

104 Circumferential rod grooves
106 Lateral hub channels
108 Key bushings
110 Selector ring
112 Selector ring circumferential channel
114 Selector ring lateral channel
116 Rod spacer
118 Adjuster knob
120 Knob cylinder
122 Knob set screw
124 Selector locking pin
140 Bench support member
142 Cord support member
144 Pulley axles
146 Pulley support member
150 Sliding bench
154 Bench wheels
156 Bench track
158 Bench bumper
160 Gas spring
170 Male frame adjustment support member
172 Female frame adjustment support member
174 Frame adjustment pin

What is claimed is:

1. An exercise machine, comprising:

at least one adjustable resistance mechanism providing continuous variable resistance and comprising a plurality of rotary viscous dampers arranged serially on a single center axis, said dampers being selectively combinable in combinations to provide varying levels of resistance;

an adjustment mechanism for selecting said dampers to provide said varying levels of resistance, said adjustment mechanism extending through each said center axis of each at least one said resistance mechanism;

a fork member supporting each said at least one resistance mechanism; and a single loop of cord connected to each at least one said resistance mechanism for allowing a force to be exerted against said resistance of each at least one said resistance mechanism.

2. The machine of claim 1, wherein the act of climbing a free-hanging rope can be simulated on the machine.

3. The machine of claim 1 having a supporting frame.

4. The machine of claim 3, wherein said frame includes at least one set of footrests.

5. The machine of claim 3, wherein the act of climbing a free-hanging rope can be simulated on the machine.

6. The machine of claim 3, wherein said frame includes at least one bench serving as a seat.

7. The machine of claim 6, wherein said bench is movable toward and away from at least one said resistance mechanism along a track connected to said frame.

8. A machine on which the act of scaling an inclined plane using a cord may be simulated, comprising:

an adjustable resistance mechanism providing continuous variable resistance, comprising a plurality of rotary viscous dampers aligned serially on a single center axis, said dampers being selectively combinable in combinations to provide varying levels of resistance;

a single loop of cord connected to said resistance mechanism for allowing a force to be exerted against said resistance of said resistance mechanism;

an adjustment mechanism for selecting said dampers to provide said varying levels of resistance, said adjustment mechanism extending through said center axis of said resistance mechanism, said adjustment mechanism including a separate key corresponding to each said damper;

an inclined movable belt mechanism connected by a transmission mechanism to said resistance mechanism; and a frame supporting said exercise machine.

9. The machine of claim 8 wherein said transmission mechanism is adjustable to vary the relative rate of movement between said belt mechanism and said resistance mechanism.

10. An exercise machine, comprising:

at least one adjustable resistance mechanism providing continuous variable resistance, comprising a plurality of rotary viscous dampers arranged serially on a single center axis, said dampers being selectively combinable in combinations to provide varying levels of resistance;

a single loop of cord connected to each at least one said resistance mechanism for allowing a force to be exerted against said resistance of each at least one said resistance mechanism;

an adjustment mechanism for selecting said dampers to provide said varying levels of resistance, said adjustment mechanism extending through each said center axis of each at least one said resistance mechanism, said adjustment mechanism including a separate key corresponding to each said damper; and a frame supporting said exercise machine.

11. The machine of claim 10 wherein said frame is inclined, said inclination being adjustable.

* * * * *